US011400739B2

(12) United States Patent
Washio et al.

(10) Patent No.: US 11,400,739 B2
(45) Date of Patent: Aug. 2, 2022

(54) RECORDING DEVICE

(71) Applicant: SEIKO EPSON CORPORATION, Tokyo (JP)

(72) Inventors: Yuichi Washio, Shiojiri (JP); Yuya Yumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/132,294

(22) Filed: Dec. 23, 2020

(65) Prior Publication Data

US 2021/0197598 A1 Jul. 1, 2021

(30) Foreign Application Priority Data

Dec. 26, 2019 (JP) ..... JP2019-237291

(51) Int. Cl.

| | |
|---|---|
| ***B41J 15/16*** | (2006.01) |
| ***G03G 15/00*** | (2006.01) |
| ***B41J 29/377*** | (2006.01) |
| ***B41J 29/17*** | (2006.01) |
| *B41J 3/407* | (2006.01) |
| *B41J 15/04* | (2006.01) |
| *B65H 23/26* | (2006.01) |

(52) U.S. Cl.

CPC ..... *B41J 15/165* (2013.01); *B41J 29/17* (2013.01); *B41J 29/377* (2013.01); *G03G 15/6502* (2013.01); *B41J 3/4078* (2013.01); *B41J 15/04* (2013.01); *B41J 15/048* (2013.01); *B65H 23/26* (2013.01); *B65H 2301/5115* (2013.01)

(58) Field of Classification Search

CPC ..... B41J 15/165; B41J 3/4078; B41J 15/048; B41J 29/17; B41J 29/377; B41J 15/04; G03G 15/6502; B65H 2301/5115; B65H 20/06; B65H 29/16; B65H 23/26; B65H 23/34; B65H 29/20; B08B 5/023

See application file for complete search history.

(56) References Cited

U.S. PATENT DOCUMENTS

| | | | | |
|---|---|---|---|---|
| 2016/0288536 | A1* | 10/2016 | Suzuki | B41J 29/377 |
| 2017/0197441 | A1* | 7/2017 | Mitsuo | B41J 3/4078 |
| 2019/0118553 | A1* | 4/2019 | Tanizaki | B41J 17/32 |

FOREIGN PATENT DOCUMENTS

| | | | | |
|---|---|---|---|---|
| CN | 208499417 | | 2/2019 | |
| CN | 209289975 | | 8/2019 | |
| EP | 3192659 | | 7/2017 | |
| EP | 3508347 | | 7/2019 | |
| JP | 2003-220695 | | 8/2003 | |
| JP | 2004-098540 | | 4/2004 | |
| JP | 2009-149028 | | 7/2009 | |
| JP | 2013-220873 | | 10/2013 | |
| JP | 2018-111275 | | 7/2018 | |
| JP | 2018111275 | A * | 7/2018 | B41J 15/04 |

* cited by examiner

*Primary Examiner* — Yaovi M Ameh
(74) *Attorney, Agent, or Firm* — Workman Nydegger

(57) ABSTRACT

A recording device includes a recording unit capable of performing recording on a medium, a holding unit capable of holding a roll body around which the medium is wound, a transporting unit that transports the medium unwound from the roll body, a tension roller that, between the holding unit and the recording unit, comes into contact with a back surface of the medium and applies tension to the medium, and a blowing unit that blows air onto a front surface of the medium. The blowing unit blows the air towards the tension roller.

12 Claims, 5 Drawing Sheets

RECORDING DEVICE

The present application is based on, and claims priority from JP Application Serial Number 2019-237291, filed Dec. 26, 2019, the disclosure of which is hereby incorporated by reference herein in its entirety.

BACKGROUND

1. Technical Field

The present disclosure relates to a recording device including a transport unit that transports a medium, such as a sheet or fabric unwound from a roll body, along a transport path, and a recording unit that performs recording on the transported medium.

2. Related Art

In JP-A-2018-111275, an inkjet printer is disclosed that is provided with a transport unit that transports a medium unwound from a roll body on which the medium is wound and which is held at an upstream position on a transport path, by taking up the medium on a roll body that is held at a downstream position on the transport path, and with a recording unit that records an image or the like by ejecting a liquid, such as ink or the like, onto the medium.

The inkjet printer described in JP-A-2018-111275 includes a housing that accommodates a printing mechanism, and a blowing device that blows an airflow onto the front surface of the medium is provided at a position upstream of the housing in a transport direction of the medium.

However, in the recording device described in JP-A-2018-111275, when foreign material, such as dust, attached to the front surface of the medium is being removed, the medium flaps due to the airflow. As a result, there is a problem that a posture of the medium may become unstable and the quality of a recorded image may deteriorate.

SUMMARY

A recording device that solves the above-described problem includes a recording unit configured to perform recording on a medium, a holding unit configured to hold a roll body around which the medium is wound, a transport unit configured to transport the medium unwound from the roll body, a tension bar configured to come into contact with a back surface of the medium and apply tension to the medium, between the holding portion and the recording portion, and a blowing unit configured to blow a gas onto a front surface of the medium. The blowing unit blows the gas toward the tension bar.

A recording device that solves the above-described problem includes a recording unit configured to perform recording on a medium, a holding unit configured to hold a roll body around which the medium is wound, a moving support unit including a support surface supporting a back surface of the medium unwound from the roll body, the moving support unit being configured to move while transporting the medium, and a blowing unit configured to blow a gas onto a front surface of the medium. The blowing unit blows the gas toward the moving support unit.

DESCRIPTION OF EXEMPLARY EMBODIMENTS

First Embodiment

Figure 1:
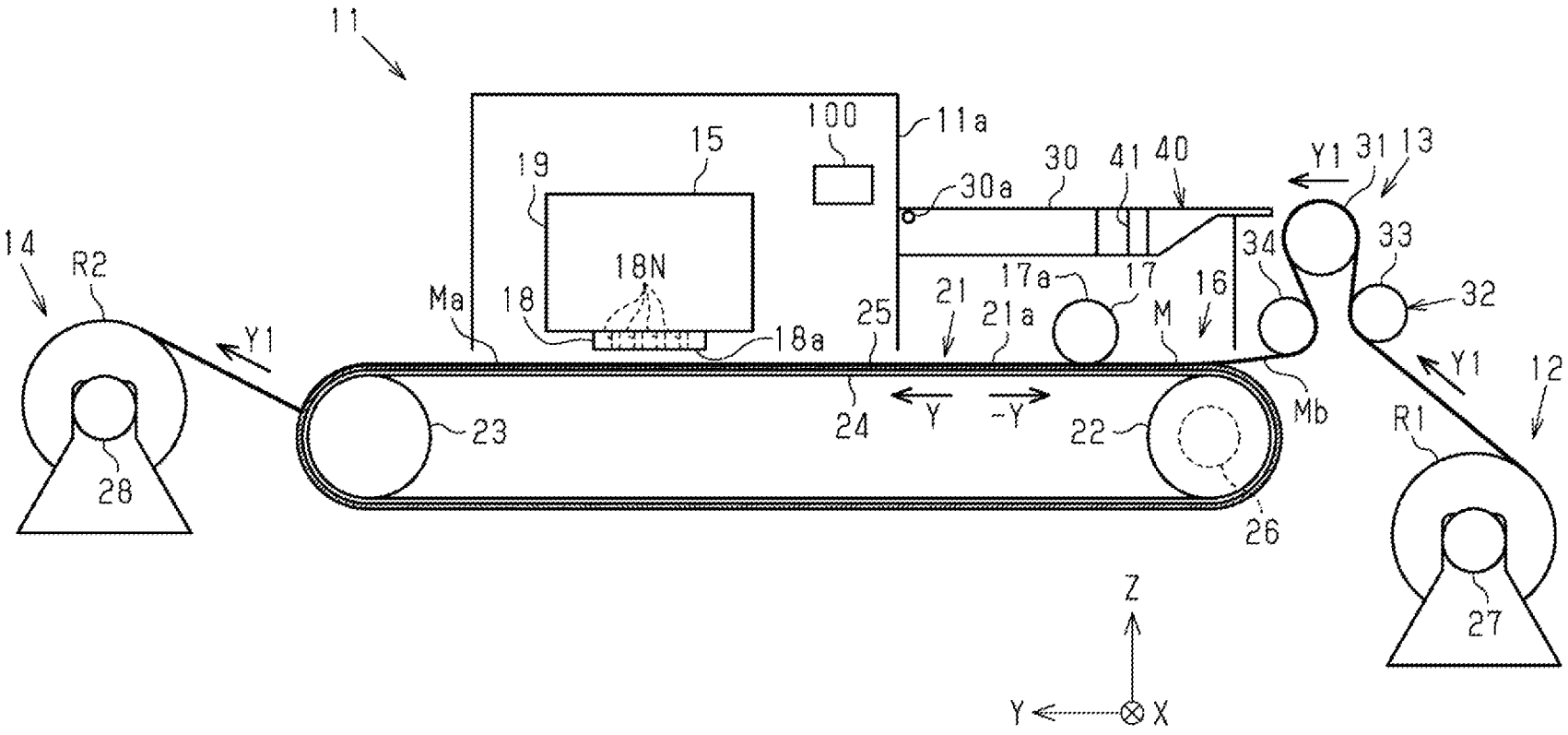
FIG. 1 is a schematic side cross-sectional view of a recording device according to a first embodiment.

A first embodiment of a recording device will be described below with reference to the drawings. In FIG. 1, it is assumed that a recording device 11 is placed on a horizontal surface, and three virtual axes orthogonal to each other are an X-axis, a Y-axis, and a Z-axis. The X-axis is a virtual axis parallel with a width direction of a transporting belt 21 described below, and the Y-axis is a virtual axis parallel with a belt transport direction Y in which a medium M on the transporting belt 21 is transported. Further, the Z-axis is a virtual axis parallel with the vertical direction. In the following description, the direction along the X-axis is also referred to as a width direction X.

As illustrated in FIG. 1, the recording device 11 is, for example, an ink jet-type printer that records an image, such as characters and a photograph, on a medium M that is a fabric, a sheet or the like, by ejecting ink, which is an example of a liquid. The recording device 11 includes a holding unit 12, a wrinkle suppressing device 13, a peeling device 14, a recording unit 15, a transporting unit 16 that is an example of a transport unit, and a pressing unit 17. The holding unit 12 holds a roll body R1 around which the medium M is wound. The transporting unit 16 transports the medium M unwound from the roll body R1. The recording unit 15 performs recording on the medium M. Note that the medium M is transported from the roll body R1 held by the holding unit 12 in a transport direction Y1 along the transport path to the roll body R2 on which the medium M is taken up after being peeled from the transporting unit 16 by the peeling unit 14. This transport direction Y1 is a direction that changes in accordance with the position of the medium M on the transport path. The belt transport direction Y, which is the transport direction of the medium M transported by the transporting unit 16, is one of the transport directions Y1. Here, the medium M is movable in the belt transport direction Y and in a reverse belt transport direction −Y that is opposite to the belt transport direction Y. The transport direction Y1 is the transport direction when a recording operation by the recording unit 15 is performed on the medium M, and the reverse belt transport direction −Y is the transport direction when, for example, an adjustment operation is performed for adjusting a medium position when setting the medium M on the transporting unit 16.

A housing 11*a* is disposed above the transporting unit 16. The recording unit 15 and a control unit 100 are accommodated in the housing 11*a*. The recording unit 15 performs recording on the medium M, for example, by ejecting the liquid onto the medium M. The recording unit 15 includes a recording head 18 and a head holding unit 19 that holds the recording head 18. The recording head 18 includes nozzles 18N that eject droplets and a nozzle surface 18*a* in which the nozzles 18N open. The nozzle surface 18*a* faces a support face 21*a* of the transporting belt 21 with a predetermined gap therebetween. The image is recorded on the medium M by the droplets ejected from the nozzles 18N landing on a front surface Ma of the medium M adhered to the support face 21*a*.

The recording unit 15 may be a serial head that scans the medium M, or may be a line head that extends over substantially the same range as the width of the medium M. When the recording unit 15 is the serial head, the head holding unit 19 is a carriage that moves in a scanning direction parallel to the width direction X, which is the direction along the X-axis. The recording is performed on the medium M by the recording head 18 ejecting the droplets from the nozzles 18N while the carriage moves in the scanning direction. When the recording unit 15 is the line head, droplets are simultaneously ejected from the plurality of nozzles 18N arranged over the range that is substantially the same as the width of the medium M, onto the medium M that is transported at a constant velocity. Note that the recording unit 15 is not limited to the ink jet-type, and may adopt an electrophotographic method that fixes an image or the like on the medium M using various photosensitive techniques after applying a solid toner.

The transporting unit 16 includes the transporting belt 21, a driving roller 22, and a driven roller 23. The transporting belt 21 is wound around the driving roller 22 and the driven roller 23. The transporting belt 21 includes an endless base material 24 and an adhesive layer 25 provided on an outer circumferential surface of the base material 24. The adhesive layer 25 is formed by applying an adhesive to the entire circumference of the outer circumferential surface of the base material 24. In other words, the transporting belt 21 is a glue belt including the adhesive layer 25. The transporting belt 21 includes the support face 21*a*, on the surface of the adhesive layer 25, for supporting the medium M. The medium M is supported on the support face 21*a* in a state of being adhered to the surface of the adhesive layer 25.

The transporting unit 16 is provided with a transport motor 26 that serves as a drive source. The driving roller 22 is coupled to the transport motor 26 in a power transmissible manner. As the transport motor 26 is driven, the driving roller 22 rotates. As the driving roller 22 rotates, the transporting belt 21 revolves. The driven roller 23 is driven to rotate in accordance with the revolution of the transporting belt 21. In this way, the transport motor 26 transmits a driving force to the driving roller 22 to drive the transporting belt 21. The medium M adhered to the support face 21*a* is transported as a result of the revolution of the transporting belt 21. Note that the positions of the driving roller 22 and the driven roller 23 may be reversed, and the roller provided downstream in the belt transport direction Y may be the driving roller 22.

The pressing unit 17 is disposed above the support face 21*a* of the transporting belt 21 at a position upstream of the recording unit 15 in the belt transport direction Y.

The pressing unit 17 presses the medium M against the transporting belt 21. In this way, the medium M is adhered to the adhesive layer 25. The pressing unit 17 sequentially adheres the medium M to the adhesive layer 25 in accordance with the revolution of the transporting belt 21. The medium M is supported in the state of being adhered to the support face 21*a* of the transporting belt 21.

The pressing unit 17 is provided with a press roller 17*a* that comes into contact with the front surface Ma of the medium M and applies pressure to the medium M. The pressing unit 17 is provided with a movement mechanism 17*b* (see FIG. 2) that causes the press roller 17*a* to reciprocate along the support face 21*a* of the transporting belt 21. The pressing unit 17 securely adheres a back surface Mb of the medium M to the adhesive layer 25 as a result of the the press roller 17*a* being caused to reciprocate in the belt transport direction Y and the reverse belt transport direction −Y by the movement mechanism 17*b* while the press roller 17*a* applies the pressure to the medium M. Note that the press roller 17*a* may reciprocate in the width direction X or may reciprocate in an intersecting direction intersecting both the width direction X and the belt transport direction Y. Further, the pressing unit 17 is not limited to pressing the medium M against the support face 21*a* using the press roller 17*a*, and the pressing unit 17 may press the medium M against the support face 21*a* using air pressure, for example.

Figure 2:
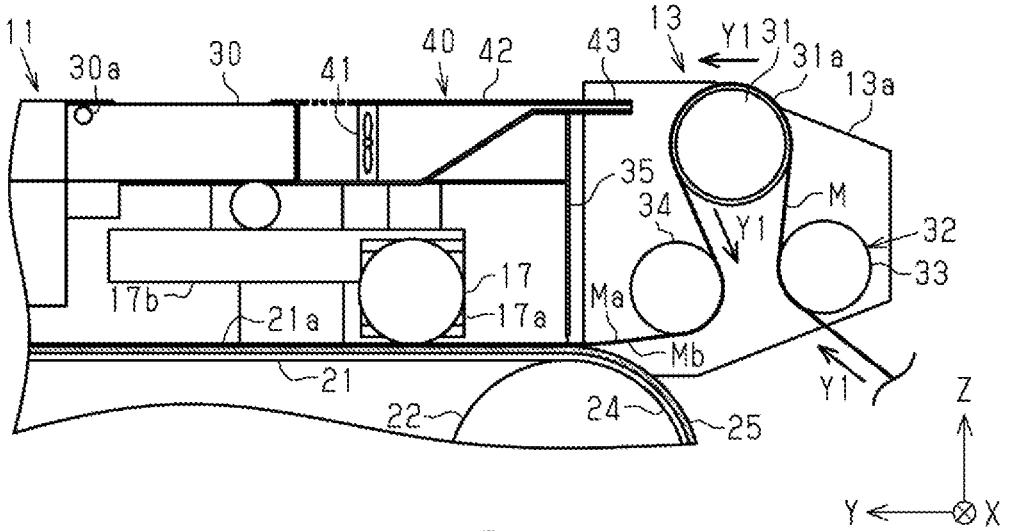
FIG. 2 is a schematic side cross-sectional view illustrating a periphery of a blowing unit.

As illustrated in FIG. 1 and FIG. 2, the recording device 11 is provided with a cover 30 that can cover a portion of the medium M on the transporting belt 21 positioned upstream of the recording unit 15 in the belt transport direction Y. In the present embodiment, the cover 30 covers a portion of the transporting unit 16 upstream, in the belt transport direction Y, of a portion covered by the housing 11*a*. Specifically, of a region facing the upper surface of the transporting belt 21, the cover 30 covers, from above, a region in the Z direction along the Z-axis that includes an arrangement space of the pressing unit 17. As illustrated in FIG. 2, the cover 30 can be opened and closed by rotating about a rotational movement shaft 30*a* provided at a downstream end of the cover 30 in the belt transport direction Y. That is, the cover 30 is displaceable with respect to the transporting unit 16.

Figure 3:
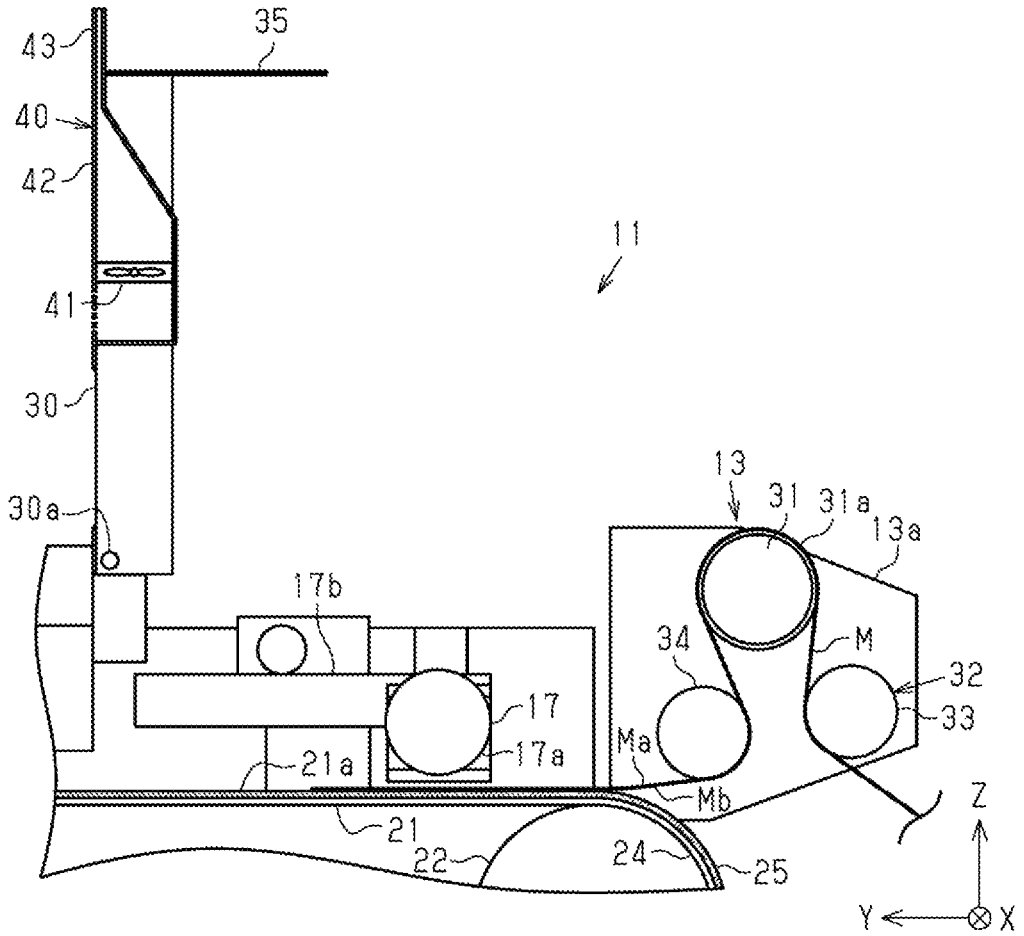
FIG. 3 is a schematic side cross-sectional view illustrating a periphery of the blowing unit when a cover is in an open state.

By moving the cover 30 from a closed position illustrated in FIG. 2 to an open position illustrated in FIG. 3, a portion of the transporting unit 16 is exposed and a setting operation to set the medium M with respect to the transporting unit 16 becomes possible. For example, when the cover 30 is in the open position, a setting operation to set the medium M on the pressing unit 17 becomes possible. Further, in a state in which the cover 30 is moved from the open position to the closed position, the pressing unit 17, and the portion of the medium M pressed by the pressing unit 17 are protected by the cover 30 from foreign material, such as dust in the outside air. Further, the cover 30 includes a partition plate 35 that forms a partition between the wrinkle suppressing device 13 and the pressing unit 17. Together with the cover 30, the partition plate 35 forms a part of a wall portion that partitions a chamber in which the pressing unit 17 is disposed. The partition plate 35 prevents foreign material from entering the chamber from the rear of the recording device 11. Note that, although FIG. 1 illustrates a portion of the recording device 11 as a side cross section, a region below both sides of the housing 11*a* and the cover 30 in the width direction X are covered by side wall portions (not illustrated).

As illustrated in FIG. 1, the medium M adhered to the support face 21*a* by the pressing unit 17 is transported in the belt transport direction Y by the revolution of the transporting belt 21. The recording unit 15 performs recording on the medium M placed on the support face 21*a* at a recording position during the transport of the medium M by the transporting belt 21.

The holding unit 12 holds the roll body R1 around which the medium M is wound. The holding unit 12 rotatably supports the roll body R1. The roll body R1 held by the holding unit 12 is a roll body around which the medium M before recording is wound. This roll body R1 is also referred to below as a first roll body R1. In the present embodiment, by driving the transporting belt 21, the medium M is unwound from the first roll body R1 held by the holding unit 12. The unwound medium M is transported along the transport path from the holding unit 12 toward the recording unit 15. In the present embodiment, the holding unit 12 is provided with a feed motor 27, which serves as a drive source for feeding out the medium M from the holding roll body R1. In the case of a configuration that includes the feed motor 27, the feed motor 27, together with the transporting unit 16, configures an example of the transport unit. Note that the feed motor 27 need not necessarily be provided when excessive tension is not applied to the medium M over a section between the first roll body R1 and the transporting belt 21.

The wrinkle suppressing device 13 is provided with a tension roller 31 as an example of a tension bar that comes into contact with the back surface Mb of the medium M and applies tension to the medium M, between the holding unit 12 and the recording unit 15. The wrinkle suppressing device 13 includes the one tension roller 31 and a roller pair 32 that can wind the medium M around the tension roller 31. The medium M can be wound around at least half the circumference of the roller 31 by the roller pair 32. The roller pair 32 is configured by two rollers, namely, a first guide roller 33 and a second guide roller 34 arranged in positions separated from each other on one side with respect to the tension roller 31. The medium M unwound from the first roll body R1 is wound around a portion of the outer circumferential surface of the tension roller 31 in a state of being guided by the first guide roller 33 and the second guide roller 34. At this time, due to a reaction when the medium M comes into contact with the outer circumferential surface of the tension roller 31, the tension roller 31 can press the medium M in directions away from each of the guide rollers 33 and 34. In this way, tension is applied to the medium M. The outer circumferential surface of the tension roller 31 is a high friction surface compared to the outer circumferential surfaces of the guide rollers 33 and 34. Note that the tension roller 31 need not necessarily be urged in the directions away from each of the guide rollers 33 and 34, or may be urged in the directions away from each of the guide rollers 33 and 34 by an elastic member, such as a spring.

A user winds the medium M pulled out from the first roll body R1 onto the tension roller 31 in an unwrinkled state. When the medium M is initially set in a taut state, the medium M does not easily slide in at least the width direction X as a result of the high friction surface that is the outer circumferential surface of the tension roller 31. Thus, the state in which the medium M is stretched in the width direction X is maintained during the process of being wound around the tension roller 31. In this way, an increase in the wrinkling of the medium M is suppressed. Wrinkles generated by meandering or skewing of the medium M cause folds that can be generated when pressed by the press roller 17*a*. In order to prevent this type of fold, the wrinkle suppressing device 13 maintains a state in which the tension is applied to the medium M in the width direction X, and thus, an increase in the wrinkling of the medium M is suppressed at a position, in the transport direction Y1, downstream of the wrinkle suppressing device 13.

Note that a non-rotatable tension rod may be used as an example of the tension bar, in place of the rotatable tension roller 31. In short, it is sufficient that, by applying the tension to the medium M, the medium M is caused to be in close contact with the outer circumferential surface of the tension bar while the back surface Mb, which is the surface opposite to the front surface Ma serving as the recording surface of the medium M, is pressed.

The peeling device 14 holds the roll body R2 around which the medium M is wound. The peeling device 14 rotatably holds the roll body R2. The roll body R2 held by the peeling device 14 is formed by winding the medium M that has passed between the recording unit 15 and the transporting belt 21. This roll body R2 is also referred to below as a second roll body R2. The peeling device 14 is provided with a winding motor 28, which serves as a drive source for winding the medium M onto the roll body R2 held by the peeling device 14. The peeling device 14 peels the medium M from the transporting belt 21 by rotating the second roll body R2 at a predetermined rotational torque, using a driving force of the winding motor 28. The peeling device 14 collects the medium M after the recording, by taking up the peeled medium M as the second roll body R2.

Note that a cleaning unit and a drying unit (not illustrated) are provided below the transporting belt 21 in the Z direction. The cleaning unit cleans the support face 21*a* in order to remove liquid such as ink, and foreign material such as fluff that attach to the support face 21*a*. The cleaning unit cleans the support face 21*a* by, for example, bringing a brush impregnated with a cleaning liquid into contact with the support face 21*a*. After the cleaning, the drying unit heats and dries the supporting surface 21*a* made wet by the cleaning liquid. Below the transporting belt 21, the drying unit is positioned upstream in the revolution direction of the transporting belt 21, and the drying portion is positioned downstream in the revolution direction. The cleaning of the support face 21*a* and the drying of the support face 21*a* made wet by the cleaning liquid are sequentially performed as a result of the revolution of the transporting belt 21.

A plurality of liquid storage containers (not illustrated) containing a liquid such as ink are disposed inside the housing 11*a*. Each of the plurality of liquid storage containers contains an ink of a different color, including, for example, black, cyan, magenta, and yellow. The liquid contained in the liquid storage container is supplied to the recording unit 15 through a tube (not illustrated). The recording unit 15 ejects the liquid supplied from the liquid storage container from the nozzles 18N of the recording head 18. The liquid storage container is configured by any of an ink tank, an ink cartridge, and an ink pack, for example.

As illustrated in FIG. 1, the recording device 11 of the present embodiment is provided with the blowing unit 40 that blows air, as an example of a gas, onto the front surface Ma of the medium M. The blowing unit 40 is positioned upstream of the recording unit 15 in the transport direction Y1, and blows air from a nozzle 43 toward the medium M. The blowing unit 40 is provided on the cover 30 and is movable, with the cover 30, relative to the tension roller 31. The blowing unit 40 of the present embodiment blows the air toward the front surface Ma of a portion of the medium M wound around the tension roller 31. The blowing unit 40 blows an airflow in the direction toward the upstream in the belt transport direction Y. By blowing the air, the blowing unit 40 removes foreign material, such as dust, fluff, or the like attached to the front surface Ma of the medium M. The foreign material, such as fluff, that has been removed from the medium M by the airflow from the blowing unit 40, is blown off along with the airflow in a direction opposite to the recording head 18. Since the front surface Ma of the portion of the medium M wound around the outer circumference of the tension roller 31 configuring the wrinkle suppressing device 13 has no wrinkles and the air can be cleanly blown thereon, the blowing unit 40 blows the air onto this portion.

As illustrated in FIG. 1, the blowing unit 40 blows the air toward the tension roller 31. The blowing unit 40 blows the air toward the front surface Ma of the portion of the medium M wound around the outer circumferential surface of the tension roller 31. The foreign material, such as dust and fluff, attached to the front surface Ma of the medium M are blown off and separated from the front surface Ma of the medium M by the blown air.

The control unit 100 controls the recording device 11. The control unit 100 controls the blowing unit 40, the pressing unit 17, the transport motor 26 of the transporting unit 16, and the recording unit 15.

Next, a series of operations of the recording device 11 will be described.

By driving the transporting belt 21, the medium M is unwound from the first roll body R1 held by the holding unit 12. Tension is applied to the unwound medium M by the tension roller 31 of the wrinkle suppressing device 13. By applying the tension, wrinkling of the medium M is suppressed. The portion of the medium M wound around the tension roller 31 closely adheres to the outer circumferential surface of the tension roller 31 while the back surface Mb is pressed against the outer circumferential surface of the tension roller 31. The nozzle 43 of the blowing unit 40 blows the air onto the front surface Ma of the portion of the medium M wound around the tension roller 31. The foreign material, such as fluff or the like, attached to the front surface Ma serving as the recording surface of the medium M is removed in advance, before the recording, by the blown air.

The pressing unit 17 presses a gas blowing region, in which the gas is blown onto the medium M, and adheres the medium M to the transporting belt 21. Next, the recording unit 15 performs the recording on the medium M adhered to the upper surface of the transporting belt 21, at the recording position. Next, the peeling device 14 peels the recorded medium M adhered to the upper surface of the transporting belt 21 from the transporting belt 21. In this way, as a result of the revolution of the transporting belt 21, the adhering of the medium M, the recording on the medium M, and the peeling of the recorded medium M are performed sequentially.

Configuration of Wrinkle Suppressing Device

Next, a configuration of the wrinkle suppressing device 13 will be described with reference to FIG. 2 and FIG. 3.

As illustrated in FIG. 2, a friction member 31*a* made of a high friction material is formed on the outer circumferential surface of the tension roller 31 configuring the wrinkle suppressing device 13. In other words, the friction member 31*a* is provided on the portion of the tension roller 31 that comes into contact with the back surface Mb of the medium M. The friction member 31*a* is configured, for example, by a tape of which at least a front surface layer is made of a high friction material. A coefficient of friction of the outer circumferential surface of the tension roller 31 is higher than a coefficient of friction of the outer circumferential surfaces of the two guide rollers 33 and 34 configuring the roller pair 32.

The three rollers 31, 33 and 34 configuring the wrinkle suppressing device 13 are supported in a state of being rotatable with respect to a frame 13*a* extending rearward of the recording device 11. An axial direction of the three rollers 31, 33, and 34 is parallel to the X-axis.

The tension roller 31, which is the main roller of the wrinkle suppressing device 13, is a driven roller, and rotates by the same amount as a transport amount of the medium M resulting from a force of the medium M being pulled by the transporting belt 21. The two guide rollers 33 and 34 are metal rollers, for example. Thus, the two guide rollers 33 and 34 are somewhat slippery with respect to the medium M that is the fabric or the like.

In the wrinkle suppressing device 13, the tension roller 31 is positioned at a highest position, and the first guide roller 33 is positioned below the tension roller 31 and upstream of the tension roller 31 in the transport direction Y1. The second guide roller 34 is positioned below the tension roller 31 and downstream of the tension roller 31 in the transport direction Y1. The medium M unwound from the first roll body R1 is wound over an angle range of 180 degrees (half a circumference) or more of an upper portion of the outer circumferential surface of the tension roller 31, after the medium M has extended upward via a portion of the outer circumferential surface, of the first guide roller 33, that faces the second guide roller 34. In the example illustrated in FIG. 3, an interval between the two guide rollers 33 and 34 is narrower than the diameter of the tension roller 31, and the medium M is wound over an angle range of approximately 200 degrees of the outer circumferential surface of the tension roller 31. Furthermore, the medium M that has passed the outer circumferential surface of the tension roller 31 extends downward, and extends toward the upper surface of the transporting belt 21 via a portion, of the outer circumferential surface of the second guide roller 34, that faces the first guide roller 33. Note that a winding angle of the medium M with respect to the outer circumferential surface of the tension roller 31 is preferably 180 degrees or more, but may be less than 180 degrees. As long as the required tension can be applied to the medium M, the winding angle may be 90 degrees, for example.

Figure 6:
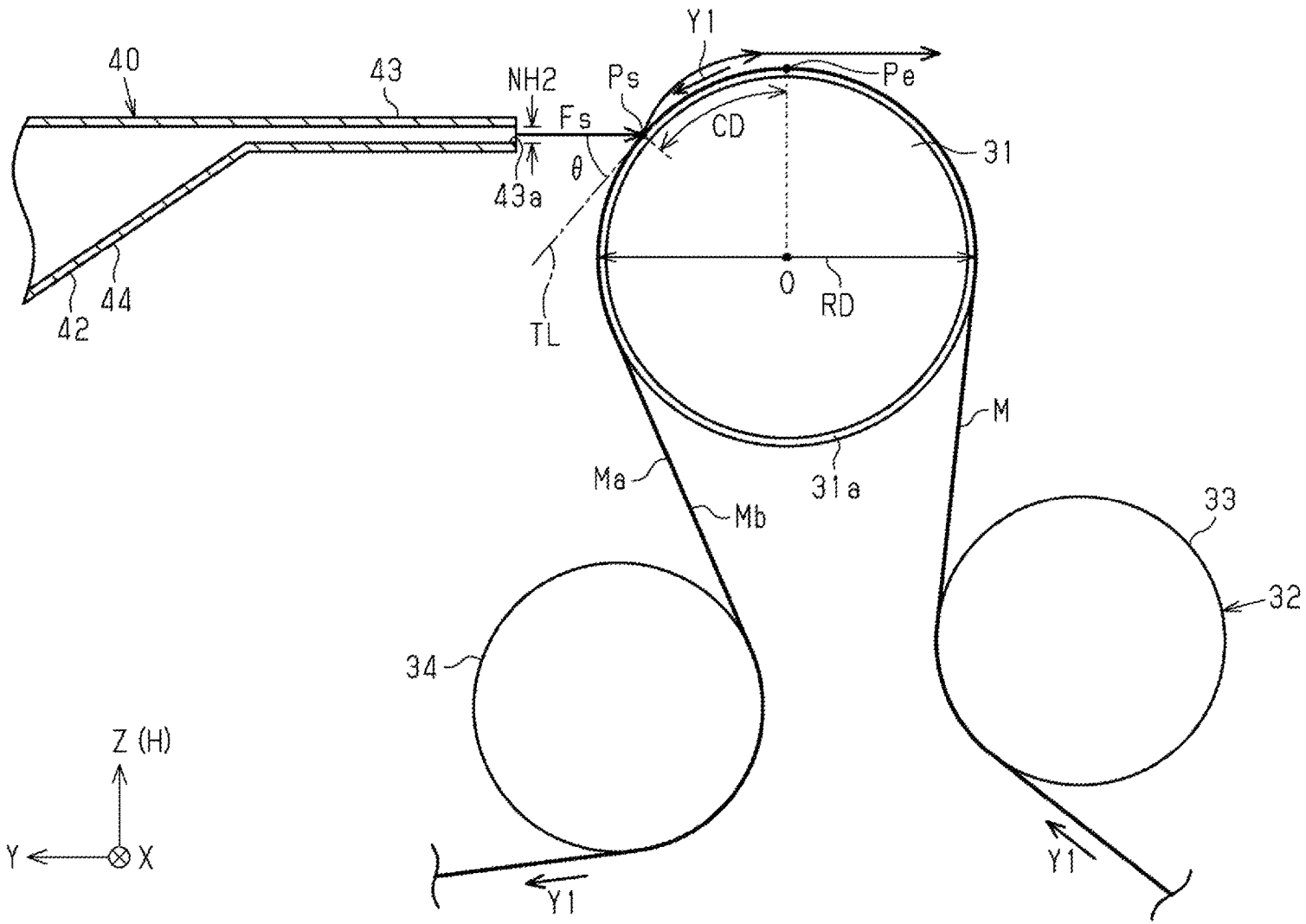
FIG. 6 is a schematic side view describing blowing conditions of the blowing unit.

As illustrated in FIG. 2 and FIG. 6, the blowing unit 40 is provided with a fan 41 and a duct 42 inside which the fan 41 is disposed. The duct 42 includes the nozzle 43 that takes in outside air as a result of the rotation of the fan 41, and blows out the taken-in outside air as it is, as the air. The blowing unit 40 is attached at a position in the vicinity of the wrinkle suppressing device 13. The blowing unit 40 includes the nozzle 43 at a leading end portion of the duct 42. In other words, the blowing unit 40 includes the nozzle 43 capable of blowing the gas in a direction from the recording unit 15 toward the tension roller 31. The blowing unit 40 blows the taken-in outside air (air) from the nozzle 43 toward the tension roller 31.

Retraction Mechanism of Blowing Unit

Next, with reference to FIG. 2 and FIG. 3, a retraction mechanism of the blowing unit 40 will be described.

The blowing unit 40 illustrated in FIG. 2 and FIG. 3 is attached to the cover 30 that covers the top of the pressing unit 17. Thus, by opening and closing the cover 30, the blowing unit 40 can be moved between a blowing position in which the airflow is blown from the nozzle 43 toward the tension roller 31 and a retracted position in which the blowing unit 40 is not an obstruction when setting the medium M on the tension roller 31. In other words, the blowing unit 40 is movable with respect to the tension roller 31. The blowing unit 40 is configured to be movable, and thus the retraction mechanism is configured to retract the blowing unit 40 when not needed. In other words, in the present embodiment, the openable/closable cover 30 serves as the retraction mechanism of the blowing unit 40.

When the medium M is set in the recording device 11, the medium M is fed to the support face 21*a* of the transporting belt 21 via the tension roller 31, and the medium M is set so as to be pressed by the press roller 17*a* on the support face 21*a*. At this time, since it is necessary to pass the medium M between the press roller 17*a* and the support face 21*a*, the user moves the cover 30 from the closed position to the open position when setting the medium M. Then, when moving the cover 30 to the open position, the blowing unit 40 is retracted downstream in the belt transport direction Y, away from the tension roller 31. In other words, when the user moves the cover 30 from the closed position to the open position, the blowing unit 40 is retracted away from the tension roller 31.

On the other hand, the user who has finished setting the medium M moves the cover 30 in the open position illustrated in FIG. 3 to the closed position illustrated in FIG. 2. As a result of the cover 30 being moved to the closed position, the blowing unit 40 is positioned in the blowing position in which the nozzle 43 is in a posture oriented toward the tension roller 31. In this way, when the user moves the cover 30 to the open position for the setting operation to set the medium M, the blowing unit 40 is retracted to the position away from the tension roller 31, and thus, the setting operation for the user to set the medium M on the tension roller 31 becomes easier. Then, when the user that has finished the setting operation moves the cover 30 to the closed position, in order to cover the arrangement space of the pressing unit 17, the blowing unit 40 is disposed in the blowing position. Thus, when a normal operation that needs to be performed when performing the setting operation to set the medium M is performed, the blowing unit 40 can be moved to the appropriate retracted position at an appropriate timing without operating a special retraction mechanism. Further, during the operation of the recording device 11, the cover 30 covers the pressing unit 17 from above in the Z direction, thereby suppressing the attachment of foreign material to the front surface Ma of the medium M that is being transported while being adhered to the support face 21*a* of the transporting belt 21.

Configuration of Blowing Unit

Figure 4:
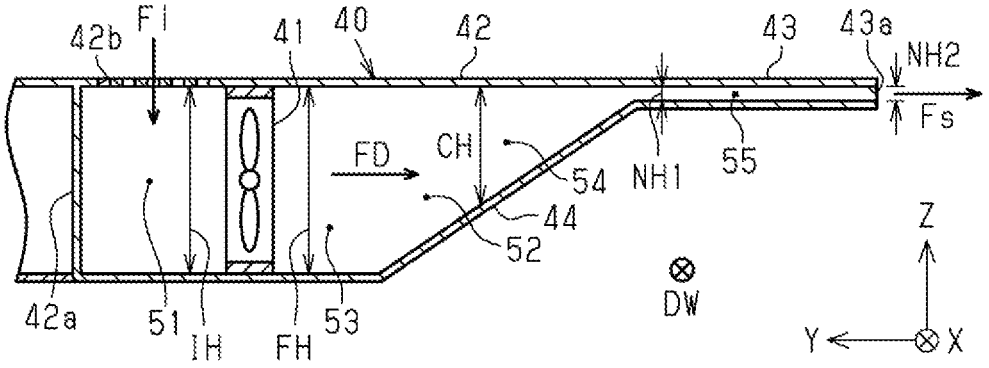
FIG. 4 is a schematic side cross-sectional view illustrating the blowing unit.
Figure 5:
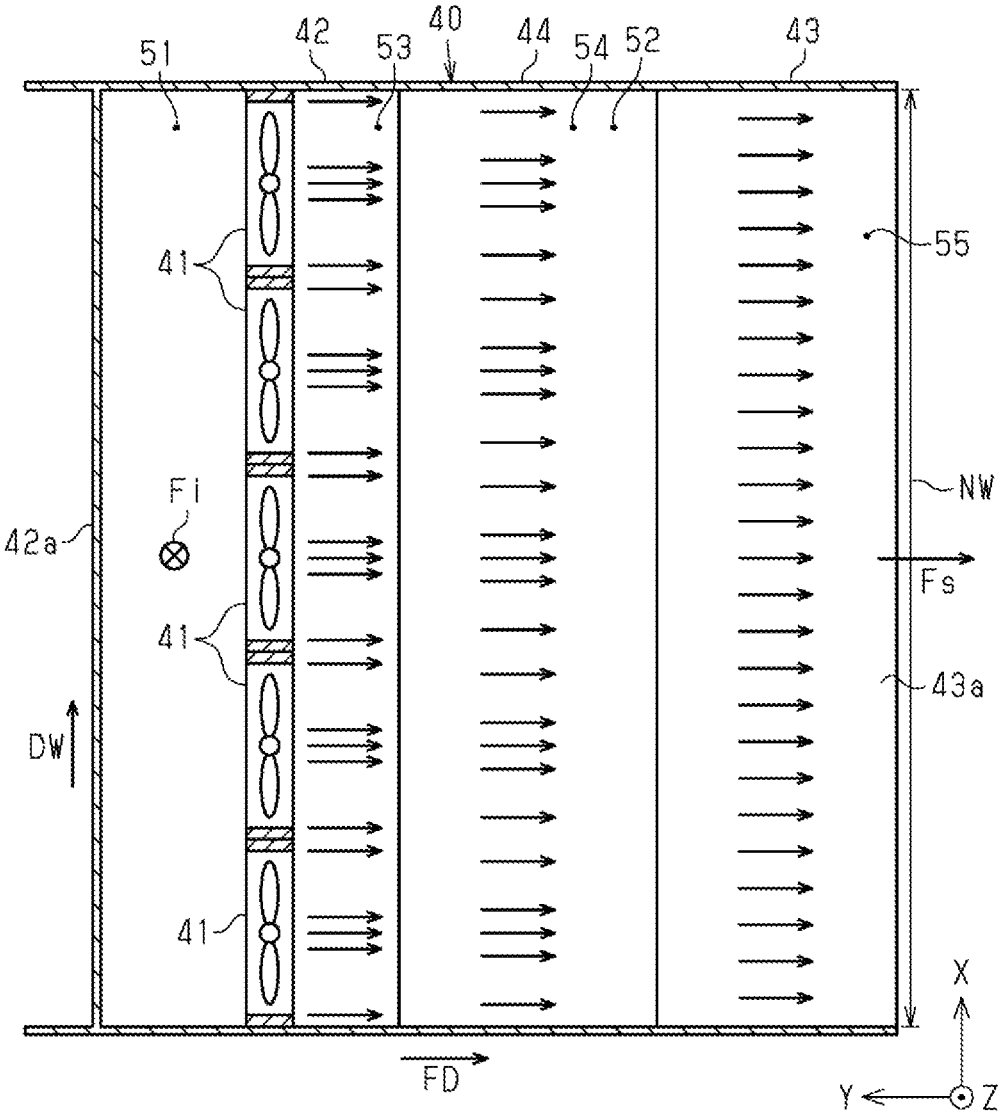
FIG. 5 is a schematic plan cross-sectional view illustrating the blowing unit.

Next, a detailed configuration of the blowing unit 40 will be described with reference to FIG. 4 and FIG. 5. As illustrated in FIG. 4 and FIG. 5, the blowing unit 40 is provided with at least one of the fans 41, and the duct 42. The fan 41 is disposed inside the duct 42. The fan 41 is an axial fan, for example. In the present embodiment, a plurality of the fans 41 are disposed side by side in a duct width direction DW. The number of fans 41 may be set to an appropriate number according to the width of the transporting belt 21, a required amount of air and air velocity, and the like. Although the number of the fans 41 is five in the example illustrated in FIG. 5, the number of the fans 41 may be 6 to 10, or may be 2 to 4, for example. In addition, the number of the fans 41 may be one, as long as the required amount of air and air velocity are obtained.

The duct 42 includes an air intake chamber 51 to take in the outside air, and an exhaust chamber 52 positioned on the opposite side from the air intake chamber 51 with the fans 41 interposed therebetween. The duct 42 includes a partition wall 42*a* disposed at an interface between a portion of the cover 30 and a portion of the duct 42. The air intake chamber 51 is configured by a chamber formed inside the duct 42 between the fans 41 and the partition wall 42*a*. A plurality of air intake ports 42*b* are open in a portion of the duct 42 that forms an upper wall of the air intake chamber 51. When the fans 41 are driven, the outside air is introduced into the intake chamber 51 through the intake ports 42*b*, in an air intake direction Fi. In the state in which the blowing unit 40 is positioned in the blowing position, each of the intake ports 42*b* is preferably disposed above each of the fans 41 in the Z direction, in order to facilitate the taking in of the outside air. Note that a filter capable of capturing foreign material, such as dust or the like, may be attached to each of the intake ports 42*b*.

Uniformity of Airflow Inside Duct

Inside the duct 42, the exhaust chamber 52, which is a region downstream of the fans 41 in an airflow direction FD, includes a flat region 53, an inclined region 54, which is an example of a rectifying region, and a nozzle region 55. The flat region 53, the inclined region 54, and the nozzle region 55 are positioned in this order in the airflow direction FD from the fans 41 toward the nozzle 43. The flat region 53 is a region in which a height FH of the space in the Z direction inside the duct 42 (hereinafter also referred to as a "duct inner height") is the same as a height of the portion in which the fans 41 are disposed. In other words, the duct inner height FH of the flat region 53 is the same as a duct inner height IH of the air intake chamber 51. The inclined region 54 is a region in which a duct inner height CH decreases continuously or in a stepped manner toward the nozzle 43. In the present embodiment, the duct inner height CH of the inclined region 54 decreases continuously toward the nozzle 43. The nozzle region 55 is a region in which a duct inner height NH1 extends over a predetermined length at the same height as an opening height NH2 of an outlet port 43*a* of the nozzle 43. Note that the opening height NH2 of the outlet port 43*a* may be smaller than the duct inner height NH1 of the nozzle region 55.

The duct 42 is provided with the air intake ports 42*b* that are provided inside the air intake chamber 51, an inclined portion 44 including the inclined region 54 therein, and the nozzle 43 including the nozzle region 55 therein. In this way, the airflow from the nozzle 43 is blown at a certain or higher air velocity, and a flow velocity thereof is uniform in the width direction X. FIG. 5 illustrates arrows that schematically indicate flow lines of the airflow supplied from the fans 41. As illustrated in FIG. 6, in the flat region 53 closest to the fans 41, there are fluctuations in the density of the flow lines of the airflow. In the inclined region 54, the duct inner height CH becomes smaller toward the nozzle 43, and thus, the fluctuations in the density of the flow lines of the airflow are gradually reduced in the course of the air passing through the inclined region 54. In the nozzle region 55, the flow lines of the airflow are uniform. The airflow is blown from the outlet port 43*a* of the nozzle 43 at a uniform flow rate in the duct width direction DW. In the present embodiment, the opening height NH2 of the outlet port 43*a* of the nozzle 43 is a predetermined value (7 mm, for example), within a range of 2 to 10 mm.

The duct 42 has a predetermined shape including the air intake chamber 51 and the exhaust chamber 52, and has a width that is substantially the same as the width dimension of the transporting belt 21. The duct 42 has the same width in the duct width direction DW across the entire region of the intake chamber 51 and the exhaust chamber 52.

The blowing unit 40 includes the duct 42 through which the gas flow can pass, and the plurality of fans 41, which are accommodated inside the duct 42 and aligned in the duct width direction DW intersecting the airflow direction FD in which the gas flow flows. The duct 42 includes the nozzle 43 that blows the airflow and the inclined region 54, which is an example of the rectifying region positioned between the fans 41 and the nozzle 43 in the airflow direction FD, and in which the duct inner height in the height direction H intersecting the airflow direction FD and the duct width direction DW becomes continuously smaller.

Positional Relationship between Air Intake Port and Outlet Port of Blowing Unit

As illustrated in FIG. 4 and FIG. 5, the air intake direction Fi of an air intake flow taken in through the air intake ports 42*b* intersects with a blowing direction Fs of the airflow blown out from the outlet port 43*a*. In the present embodiment, the blowing unit 40 blows the airflow in a horizontal direction from the nozzle 43, as a result of the fans 41 supplying the air taken into the duct 42 by being sucked from above to below via the air intake ports 42*b*, in the horizontal direction. In this way, the orientation of the air intake ports 42*b* is configured such that the air intake direction Fi at the air intake ports 42*b* intersects with the blowing direction Fs at the outlet port 43*a*. As a result, in the blowing direction Fs, compared with a case in which the air intake ports 42*b* are provided on the same side as the air outlet port 43*a*, it is possible to suppress the foreign material, such as fluff, blown out by the blowing of the air from being taken once more into the duct 42 from the air intake ports 42*b*. In this way, it is possible to avoid a situation in which the air containing the foreign material is blown from the nozzle 43 toward the front surface Ma of the medium M.

Size Conditions of Nozzle and Tension Roller

A relationship between the opening height NH2 of the outlet port 43*a* of the nozzle 43 and a diameter RD of the tension roller 31 is expressed by NH2<RD. In the present example, the opening height NH2 of the outlet port 43*a* is a predetermined value within a range of 1/30 to 1/5, for example, of the diameter RD of the tension roller 31. Since the relationship NH2<RD is established, the air blown from the nozzle 43 in the blowing direction Fs can be narrowed and blown onto an appropriate position on the outer circumferential surface of the tension roller 31, that is, onto a specific area on the front surface Ma of the medium M. Further, in the state in which the blowing unit 40 is positioned in the blowing position, the position of the nozzle 43 is appropriately designed so that the nozzle 43 overlaps with the tension roller 31 when viewed from the blowing direction Fs.

Then, a suitable blowing angle θ of the nozzle 43 described above is defined based on an assumption that the opening height NH2 of the outlet port 43*a* of the nozzle 43 is smaller than the diameter RD of the tension roller 31.

Blowing Conditions

As illustrated in FIG. 6, the nozzle 43 of the blowing unit 40 blows the air onto the front surface Ma of a portion of the medium M that does not flap even when the air is blown. Further, the nozzle 43 of the blowing unit 40 blows the air onto the front surface Ma of the medium M at a portion positioned upstream of the press roller 17*a* in the transport direction Y1. The tension roller 31 is a member that applies tension to the medium M. Thus, the portion of the medium M wound around the outer circumferential surface of the tension roller 31 is in close contact with the outer circumferential surface of the tension roller 31. Furthermore, since the outer circumferential surface of the tension roller 31 is the high friction surface due to the friction member 31*a*, in comparison to the outer circumferential surfaces of the two guide rollers 33 and 34 configuring the roller pair 32, the medium M is unlikely to slip laterally along a roller axial direction. Thus, the state is maintained in which the portion of the medium M wound around the outer circumferential surface of the tension roller 31 is stretched in both the transport direction Y1 and in the width direction X. As a result, the medium M is maintained in a state of being free of wrinkles in the course of passing via the tension roller 31. That is, wrinkles in the medium M are removed in the course of passing via the tension roller 31. The medium M is wound around the outer circumferential surface of the tension roller 31 in the state in which the tension is applied, and thus the medium M is in close contact with the outer circumferential surface of the tension roller 31. Thus, an adhesive force between the medium M and the outer circumferential surface is high at the portion at which the medium M is wound on the outer circumferential surface of the high friction surface in the state of the tension being applied. Thus, even when the air is blown from the nozzle 43, the portion of the medium M wound around the tension roller 31 is less likely to flap. In other words, even when the air is blown from the nozzle 43, the posture of the portion of the medium M wound around the tension roller 31 tends to be stable.

Blowing Angle

In the side view illustrated in FIG. 6, the blowing angle θ is indicated by an angle with respect to a reference line TL which is the tangent line at the blowing position (an intersection point Ps), which is a position of impact of the air blown in the blowing direction Fs from the nozzle 43. In other words, when an intersection point at which an extension line of the blowing direction Fs of the nozzle 43 intersects with the outer circumferential surface of the tension roller 31 is Ps, the blowing angle θ is expressed by the angle formed with the reference line TL when the tangent line at the intersection point Ps is the reference line TL. However, θ is defined within a range of $0 \leq \theta \leq 90$. The orientation direction of the nozzle 43 is set such that the blowing direction Fs has a directional component in the direction opposite to the belt transport direction Y. In the present embodiment, the blowing direction Fs is set in a horizontal direction directly opposite to the belt transport direction Y, thus having only the directional component in the direction opposite to the belt transport direction Y. This direction is also referred to as a counter transport direction, and is defined in the same way as the reverse belt transport direction −Y described above.

In the present embodiment, the blowing angle θ is set to a value from 0 degrees or more and 90 degrees or more ($0 \leq \theta \leq 90$).

If the blowing angle θ is too small, the airflow from the nozzle 43 flows only along the front surface Ma of the medium M, and therefore, a collision between the airflow and the front surface Ma of the medium M is unlikely to occur. For this reason, the airflow from the nozzle 43 collides with the front surface Ma of the medium M at a certain angle in order to enhance a foreign material removal performance, and the blowing angle θ is preferably equal to or greater than 30 degrees. Further, if the blowing angle θ is too large, after the airflow collides with the front surface of the medium M, one of flows that diverge in two opposite directions from the collision location along the outer circumferential surface of the tension roller 31 is directed toward the recording unit 15, and foreign material contained in the air stream may attach to the nozzle surface 18*a* of the recording head 18, which may result in an ejection failure. For this reason, the blowing angle θ is preferably less than 70 degrees so that a ratio of the amount of airflow flowing downstream in the belt transport direction Y is relatively small with respect to the amount of airflow flowing upstream in the belt transport direction Y. Therefore, the blowing angle θ is preferably at least 30 degrees and less than 70 degrees.

In particular, in the present example, based on results of experiments and simulation results for the blowing angle θ, the blowing angle θ is set to a value of at least 45 degrees and less than 55 degrees, taking into account a foreign material removal performance when a strong airflow is caused to collide with the front surface Ma, and a foreign material reattachment prevention performance when the airflow containing the foreign material is prevented from flowing in the direction of the recording unit 15. This is based on the fact that when the blowing angle θ is less than 45 degrees, while the foreign material reattachment prevention performance is high, a deterioration is observed in the foreign material removal performance, and when the blowing angle θ is equal to or greater than 55 degrees, while the foreign material removal performance is high, the airflow flowing in the direction of the recording unit 15 increases and a deterioration is observed in the foreign material reattachment prevention performance.

Air Velocity

A favorable air velocity of the airflow blown from the nozzle 43 is equal to or greater than 6 m/s. Based on results of experiments and simulation results, a foreign material removal effect was observed at velocities of 6 m/s and 8 m/s. A deterioration in the foreign material removal effect was observed when the velocity is less than 3 m/sec. Therefore, it is sufficient that the air velocity is not less than 3 m/s, and particularly preferably is equal to or greater than 6 m/sec.

Blowing Distance

A blowing distance CD is a distance represented, using a circumferential length, of a range of the air flowing from the blowing position Ps along the the portion of the front surface Ma wound around the outer circumferential surface of the tension roller 31 in a direction away from the recording unit 15.

In the case of the configuration in which air is blown horizontally from the nozzle 43, an intersection point between an imaginary line, which extends in the vertical direction from a center O of the tension roller 31 and is indicated by a dashed line in FIG. 6, and the outer circumferential surface of the tension roller 31 is a highest point Pe on the outer circumferential surface of the tension roller 31. After the air blown horizontally from the nozzle 43 collides with the blowing position Ps, the air flows to the highest point Pe primarily along the front surface Ma of the medium M toward the direction opposite to the transport direction Y1. After that, the airflow is discharged to the rear in the direction opposite to the recording head 18 side, away from the front surface Ma of the medium M. In other words, the orientation of the airflow after being blown onto the front surface Ma of the medium M changes at each point on the outer circumferential surface of the tension roller 31. The blowing position Ps is determined such that the blowing distance CD is a required distance. Effects were observed both when the blowing distance CD was equal to or greater than 30 mm and when the blowing distance CD was equal to or greater than 60 mm. The blowing distance CD did not have a significant impact on the foreign material removal performance, and constant effects were obtained even with a relatively short distance (less than 30 mm).

Blowing Time

Next, a blowing time will be described. When the recording device 11 is the serial printer, the recording operation, in which the liquid is ejected from the nozzles 18N of the recording head 18 while moving the carriage, which is the head holding unit 19, in the scanning direction, and a transport operation, in which the medium M is transported to the next recording position, are alternately performed. At this time, since the medium M is stopped during the recording operation, the blowing unit 40 blows the air from the nozzle 43 onto the same location on the medium M. On the other hand, during the transport operation in which the medium M is transported, the location onto which the blowing unit 40 blows the air from the nozzle 43 passes at the same velocity as the transport velocity of the medium M in one transport operation. In this way, the medium M only passes through the area onto which the air is blown, but the foreign material removal effect was confirmed by the blowing of the airflow under the above-described conditions of the blowing angle θ and air velocity. In this way, the foreign material removal effect is obtained even when the blowing time is a predetermined time within a range from 0.1 to 0.5 seconds.

If the required blowing time is long, such as longer than 1 second, for example, since the medium M is stopped at the time of the recording operation that is performed during the scanning by the carriage, the blowing time can be secured by using the stop time. However, during the transport operation in which the medium M is transported, the medium M only passes through the blowing area, so the required blowing time cannot be secured. In this case, a countermeasure is necessary, such as slowing down the transport velocity or securing a long blowing area in the transport direction Y1. The former countermeasure has an adverse effect of reducing the recording velocity, and the latter is disadvantageous in that the size of the blowing unit 40 increases, an arrangement number increases, and the like.

In the present embodiment, the airflow is blown from the nozzle 43 onto the portion of the outer circumferential surface of the tension roller 31 on which the medium M is wound and at which the outer circumferential surface and the medium M closely adhere to each other with the high adhesive force. For example, if the medium M flaps as a result of the blowing of the air, not only does the posture of the medium M become unstable, but the medium M moves, which reduces the foreign material removal effect by the airflow. Further, wrinkles are generated in the medium M in a portion with low adhesion at a level at which there is light contact with the back surface of the medium M. If the air is blown onto a portion of the medium M that has wrinkles, the foreign material removal effect is reduced in the wrinkled portion and in portions surrounding the wrinkles, and the recording is performed on the medium M with the foreign material that is not completely removed due to the wrinkles remaining attached to the medium M. In this case, there is a risk that the portion to which the foreign material is attached results in a recording failure.

In contrast, in the present embodiment, since the air is blown onto the portion of the front surface Ma at which the back surface Mb of the medium M from which wrinkles have been removed is adhered to the outer circumferential surface of the tension roller 31, flapping, lifting, and wrinkles of the medium M are suppressed, and a superior foreign substance removal effect can be obtained. Thus, the foreign material is removed even with a short blowing time in which the medium M passes through the blowing area during the transport operation. Thus, regardless of whether the recording device 11 is the serial printer or the line printer, by applying the blowing unit 40, the required foreign material removal effect can be obtained.

Advantages of Liquid Ejection Method

When the recording device 11 includes the recording unit 15 that is a liquid ejecting system (ink jet-type) that ejects the liquid, foreign material, such as dust or fluff, attached to the medium M may be caused to fly up by a liquid jet generated when the liquid is sprayed from the nozzles 18N, and the foreign material may attach to the nozzle surface 18*a* of the recording head 18. Foreign material attached to the nozzle surface 18*a* is a cause of an ejection failure. Droplets discharged from the nozzles 18N come into contact with the foreign material attached in the vicinity of the nozzle 18N, and a trajectory of the droplet is bent. As a result, the landing position of the droplet is displaced, which may lead to a reduction in recording accuracy. Further, the foreign material attached to the nozzle surface 18*a* causes an ejection failure, clogging, and the like, such as dot omission in which the droplets are not ejected from the nozzles 18N. In contrast, in the present embodiment, the blowing unit 40 removes, in advance, the foreign material attached to the front surface Ma that will be the recording surface of the medium M, at a position upstream of the recording unit 15 in the transport direction Y1. Thus, the amount of foreign material that enters the vicinity of the recording unit 15 along with the medium M can be reduced. As a result, the ejection failure and clogging caused by the attachment of the foreign material to the nozzle surface 18*a* can be reduced.

Electrical Configuration of Recording Device

Figure 7:
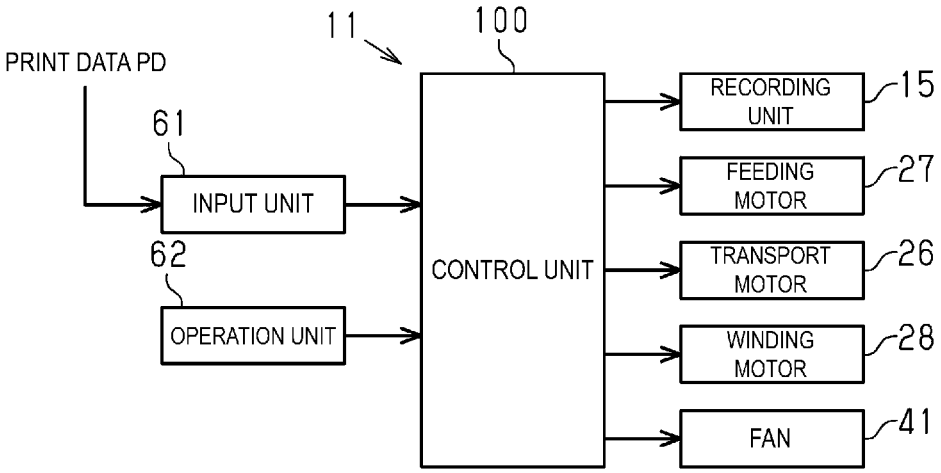
FIG. 7 is a block diagram illustrating an electrical configuration of the recording device.

Next, an electrical configuration of the recording device 11 will be described with reference to FIG. 7.

The recording unit 15, the transport motor 26, and the fan 41 are electrically coupled to the control unit 100. The control unit 100 controls the transport motor 26 so that the transporting belt 21 is at the predetermined transport velocity. Further, the control unit 100 can control an output torque of the transport motor 26 so that the tension on the medium M pulled by the driving of the transporting belt 21 is not excessive, and can adjust the tension on the medium M from the first roll body R1 held by the holding unit 12 to the transporting belt 21.

Further, an input unit 61 and an operation unit 62 are electrically coupled to the control unit 100. The input unit 61 is a communication interface having input functions capable of inputting various types of data. The control unit 100 inputs print data PD via the input unit 61.

The operation unit 62 includes an operating switch that is operated by the user to issue various commands with respect to the recording device 11. The operation unit 62 may be an operation panel provided with a display unit. The operation unit 62 includes a power switch, a selection switch, and the like. Here, the display unit may be configured by a touch panel, and an operation function of the display unit may serve as a part of the operation unit 62.

In the present embodiment, the control unit 100 controls the ON/OFF of the fan 41. The control unit 100 may control the ON/OFF of the fan 41 based on an instruction by the user operating the operation unit 62. In other words, a configuration may be adopted in which the user can operate the operation unit 62 and can select the ON/OFF of the fan 41 on a setting screen displayed on the display unit of the operation panel, for example. When the medium M is a type of the medium M from which the foreign material, such as dust or fluff, needs to be removed, the user selects ON for the fan 41, and if the medium M is a type of the medium M that does not require the foreign material removal, the user selects OFF for the fan 41. Here, when the medium M is the fabric, the types of the medium M that requires the removal of foreign material, such as fluff, include cotton and wool. Further, examples of the medium M that do not require the removal of foreign material, such as fluff, include silk and chemical fibers such as nylon.

Further, the control unit 100 may control the ON/OFF of the fan 41 on the basis of information about the medium type included in the print data PD. On the basis of the information about the medium type included in the print data PD, the control unit 100 controls the fan 41 to be ON when the medium type is a first medium type for which the foreign material removal is required. On the other hand, on the basis of the information about the medium type included in the print data PD, the control unit 100 controls the fan 41 to be OFF when the medium type is a second medium type for which the foreign material removal is not required. In this way, the control unit 100 may perform the ON/OFF control of the fan 41 based on the information about the medium type.

Note that the control unit 100 may change a rotational velocity of the fan 41 depending on the medium type. For example, the control unit 100 increases the rotational velocity of the fan 41 in the case of the type in which it is difficult to remove the foreign material from the front surface Ma, such as when the medium M is a carpet or the like, and reduces the rotational velocity of the fan 41 in the case of the type for which changes in the posture are likely, such as when the medium M is a thin, lightweight fabric. In this way, it is possible to adjust the foreign material removal performance in accordance with characteristics of the medium type.

The control unit 100 performs various controls including recording control for the recording device 11. The control unit 100 is not limited to performing software processing for all processes executed by the control unit 100. For example, the control unit 100 may be provided with dedicated hardware (an application-specific integrated circuit (ASIC), for example) that executes at least a part of the processing performed by the control unit 100. In other words, the control unit 100 can be configured by one or more processors that operate in accordance with a computer program (software), one or more dedicated hardware circuits that perform at least a part of the various processing, or circuitry including a combination thereof. The processor includes one or more CPUs, along with one or more of a memory, such as a RAM, a ROM, and the like, and the memory stores program codes or commands configured to cause the CPU to execute the processing. The memory, that is, a computer readable medium, includes any medium that can be accessed by a general purpose or dedicated computer.

Next, actions of the recording device 11 will be described.

When setting the medium M, the user moves the cover 30 from the closed position illustrated in FIG. 2 to the open position illustrated in FIG. 3. As a result of the user opening the cover 30, the blowing unit 40 moves from the blowing position illustrated in FIG. 2 to the retracted position away from the tension roller 31 illustrated in FIG. 3. The user pulls out the medium M from the roll body R1 held by the holding unit 12, and winds the pulled out medium M around the first guide roller 33, the tension roller 31, and the second guide roller 34 of the wrinkle suppressing device 13, in this order. When winding the medium M around the tension roller 31, the blowing unit 40 is in the retracted position illustrated in FIG. 3, and thus does not obstruct the setting operation. Furthermore, the leading end portion of the medium M is placed on the support face 21*a* of the transporting belt 21, and the press roller 17*a* is lowered to press the medium M. Once the setting of the medium M is completed in this manner, the user operates the operation unit 62 to issue a recording start instruction to the recording device 11. The control unit 100 of the recording device 11 controls the recording device 11 based on the specified print data PD. As a result, the recording device 11 starts operations to record the image on the medium M, based on the print data.

The medium M is transported by the rotation of the transporting belt 21. At this time, since the medium M is wound around each of the rollers 31, 33, and 34 of the wrinkle suppressing device 13, the medium M is pulled by a transport force of the transporting belt 21, and the rollers 31, 33, and 34 rotate due to a resulting pulling force.

The tension roller 31 has a larger diameter than the two rollers 33 and 34 configuring the roller pair 32, the winding angle of the tension roller 31 is equal to or greater than 180 degrees as a result of the positional relationship with the roller pair 32, and the winding length of the portion of the medium M wound around the outer circumferential surface of the tension roller 31 is equal to or greater than half a circumference thereof. Further, due to the friction member 31*a*, the outer circumferential surface of the tension roller 31 is the high friction surface having the greater coefficient of friction than the outer circumferential surfaces of the two guide rollers 33 and 34. A wide contact area is secured between the medium M and the high friction surface of the tension roller 31. The medium M closely adheres to the outer circumferential surface of the tension roller 31 and is wound in a wrinkle-free state. Since the medium M is less likely to slip on the outer circumferential surface of the tension roller 31 due to the friction with the outer circumferential surface of the tension roller 31, the medium M is maintained in the state of close contact without wrinkling. Thus, tension is applied to the medium M in the longitudinal direction and in the width direction X, while being subject to pressure from the outer circumferential surface of the tension roller 31, and is wound while being stretched in the width direction X. As a result, a state is maintained in which wrinkles of the medium M are suppressed in the course of the medium M being wound around the tension roller 31. In this way, the medium M is transported in the state of being in close contact with the outer circumferential surface of the tension roller 31.

During the operation of the recording device 11, the air is blown from the nozzle 43 of the blowing unit 40 toward the tension roller 31. As a result, the airflow is blown from the nozzle 43 onto the front surface Ma of the portion of the medium M wound around the tension roller 31. The portion of the medium M onto which the airflow is blown is in close contact with the outer circumferential surface of the tension roller 31. Thus, even when the air is blown, the medium M does not flap. Further, the airflow does not enter between the medium M and the outer circumferential surface of the tension roller 31, and thus the medium M does not lift up or float from the outer circumferential surface of the tension roller 31.

For example, if a configuration is adopted in which the airflow is blown from the nozzle onto a portion of the medium M between the rollers, since the portion of the medium M between the rollers is not supported on the outer circumferential surface of the rollers, the medium M ends up flapping as a result of the airflow. When the medium M flaps, oscillation resulting from the flapping may be propagated downstream in the transport direction Y1, and the position of the medium M may be displaced due to the force of the propagated oscillation. For example, if the medium M oscillates minutely or the position of the medium is minutely displaced in the course of adhering the medium M to the support face 21*a* of the transporting belt 21, there is a concern that the medium M may be adhered to the support face 21*a* in a displaced position resulting from the oscillation or a position resulting from the displacement. In this case, wrinkles may be generated due to the displacement of the position at which the medium M is adhered to the transporting belt 21, or due to the adhered position becoming displaced. The wrinkles generated in the medium M become folds when pressed by the press roller 17*a*. The folds caused by the displacement of the adhered position of the medium M, or by the adhered position becoming displaced causes a recording position alignment failure of the image.

In contrast, in the present embodiment, the blowing location onto which the airflow from the nozzle 43 is blown is the portion of the medium M wound in the state of being in close contact with the outer circumferential surface of the tension roller 31, and thus, even when the airflow is blown, the medium M does not flap at that blowing location. As a result, accuracy of the position of adhering the medium M to the support face 21*a* of the support belt 21 is high, and wrinkles are not generated when the medium M is adhered. Thus, folds are not generated in the medium M after being pressed by the press roller 17*a*.

Since the medium M is adhered to the support face 21*a* of the transporting belt 21 with high positional accuracy, the droplets ejected from the nozzles 18N of the recording unit 15 land on the medium M on the support face 21*a* with a high degree of accuracy, and a high-quality image can be recorded on the medium M. In other words, foreign material attached to the front surface Ma of the medium M can be removed while inhibiting the posture of the medium M from becoming unstable. By stabilizing the posture of the medium M, variations in a gap between the nozzle surface 18*a* of the recording head 18 and the front surface Ma of the medium M on the support face 21*a* of the transporting belt 21 can be suppressed, and a deterioration in image quality caused by gap variations can be suppressed.

As illustrated in FIG. 5, with respect to airflow blown from the nozzle 43, the flow lines in the width direction X indicate the uniform airflow. As a result, the uniform airflow in the width direction X is blown onto the front surface Ma of the portion of the medium M wound around the tension roller 31. Thus, foreign material attached to the front surface Ma of the medium M can be effectively removed without any fluctuations in the width direction X. For example, when foreign material remains on the front surface Ma of the medium M, the foreign material attached to the medium M may be caused to fly up by the liquid jet generated when the liquid is ejected from the nozzles 18N, and the foreign material may attach to the nozzle surface 18*a* of the recording head 18. In the present embodiment, the foreign material attached to the front surface Ma of the medium M is effectively removed, so an amount of foreign material caused to fly up by the liquid jet is extremely small. Thus, even if the foreign material attaches to the nozzle surface 18*a*, for example, the amount thereof is extremely small. Thus, a frequency of occurrence of an ejection failure caused by foreign material attached to the nozzle surface 18*a* is extremely low. The deterioration in image quality due to foreign material remaining on the front surface Ma that is the recording surface of the medium M can be suppressed. According to the present embodiment, foreign material attached to the front surface Ma of the medium M can be effectively removed while maintaining the stable posture of the medium M, and thus the image quality recorded on the medium M is improved.

Further, the blowing angle θ of the airflow blown from the nozzle 43 is from 0 degrees to 90 degrees. In particular, in the present example, the blowing angle θ is in the range from 45 degrees to 55 degrees. In addition, the airflow is blown from the nozzle 43 onto the blowing position Ps, which is the position above the center O of the tension roller 31. Thus, the airflow blown from the nozzle 43 onto the blowing position Ps on the outer circumferential surface of the tension roller 31 primarily flows from the blowing position Ps to the highest point Pe along the outer circumferential surface of the tension roller 31, in the direction opposite to the belt transport direction Y. On the other hand, the airflow flowing from the blowing position Ps to the lower side is suppressed to a small amount. In this way, foreign material, such as fluff, removed from the front surface Ma by the blowing of the airflow is blown away in the direction opposite to the belt transport direction Y along with the airflow, that is, in the direction opposite to the direction in which the recording unit 15 is positioned. As a result, the foreign material removed by blowing the airflow from the nozzle 43 is prevented from reattaching to the front surface Ma of the medium M. In other words, the blowing unit 40 can blow the air toward the tension roller 31 such that the direction of the airflow is in the direction opposite to the transport direction Y1 or the belt transport direction Y in which the medium M is transported toward the recording unit 15. The transport direction Y1 referred to here refers to the transport direction of the medium M at any location on the transport path. For example, the transport direction Y refers to the transport direction of the medium M at any point on the tension roller 31. Note that "the direction of the flow of air (gas)" means that, at any point on the tension roller 31, the direction of the flow of air (gas) is not limited to being completely parallel to the transport direction Y1 of the belt transport direction Y, but also includes the fact that the direction of the flow of air (gas) may intersect the transport direction Y1 or the belt transport direction Y.

According to the Embodiment Described Above, the Following Advantages can be Obtained.

(1) The recording device 11 is provided with the recording unit 15 capable of performing the recording on the medium M, the holding unit 12 capable of holding the roll body R1 on which the medium M is wound, and the transporting unit 16 that transports the medium M unwound from the roll body R1. The recording device 11 is provided with the tension roller 31 that comes into contact with the back surface Mb of the medium M and applies tension to the medium M between the holding unit 12 and the recording unit 15, and is provided with the blowing unit 40 that blows the gas onto the front surface Ma of the medium M. The blowing unit 40 blows the gas toward the tension roller 31. In other words, the airflow is blown onto the portion of the tension roller 31 around which the medium M is wound.

Thus, the medium M is pressed by the outer circumferential surface of the tension roller 31, and a predetermined pressing force is applied to the medium M. The medium M is in close contact with the tension roller 31. Then, by the blowing unit 40 blowing the gas toward the tension roller 31, the gas is blown onto the portion at which the medium M is in close contact with the tension roller 31. Since the medium M is in close contact with the tension roller 31, the gas is suppressed from flowing between the medium M and the tension roller 31. The flapping of the medium M caused by the gas flowing between the medium M and the tension roller 31 can be suppressed. In this way, the posture of the medium M can be suppressed from becoming unstable, while removing foreign material, such as dust, attached to the front surface Ma of the medium M. In this case, a stable recording operation can be achieved. The stable recording operation referred to here refers to the suppression of variations in the gap between the nozzle surface 18*a* of the recording head 18 and the front surface Ma of the medium M on the support face 21*a* of the transporting belt 21 as a result of the posture of the medium M being stable, and, as well as being able to suppress the deterioration in image quality caused by the gap variations, the image quality is improved due to the removal of the foreign material from the front surface Ma that is the recording surface of the medium M.

(2) The friction member 31*a* is provided on the portion of the tension roller 31 that comes into contact with the back surface Mb of the medium M. Thus, the medium M can be wound by the roller pair 32 around the tension roller 31 provided with the friction member 31*a* on the portion of the tension roller 31 that comes into contact with the back surface Mb of the medium M. In this way, the medium M is inhibited from becoming displaced in the width direction X, and the posture of the medium M can be stabilized.

(3) The tension roller 31 is provided with the roller pair 32 around which the medium M can be wound, and due to the roller pair 32, the medium M can be wound around at least half the circumference of the roller 31. Thus, by winding the medium M around the tension roller 31 at the winding angle equal to or greater than the half circumference, a strong tension is applied to the portion of the medium M wound around the tension roller 31, compared to a case in which the winding angle is less than the half circumference. In this way, by suppressing the lateral displacement of the medium M in the width direction X, the occurrence of wrinkles in the medium M can be suppressed, and the posture of the medium M can be further stabilized.

(4) The blowing unit 40 blows the air toward the tension roller 31 such that the direction of the flow of air is in the direction opposite to the transport direction Y1 or the belt transport direction Y in which the medium M is transported toward the recording unit 15. Here, when the direction of the flow of air is the same as the transport direction in which the medium M is transported toward the recording unit 15, the foreign material removed from the front surface Ma of the medium M by the blowing unit moves toward the recording unit 15, and the foreign material attaches to at least a part of the recording unit 15. As a result, there is a possibility that the operation of the recording unit 15 is obstructed. In contrast, according to the present embodiment, the foreign material removed from the front surface Ma of the medium M by the blowing unit 40 is suppressed from moving toward the recording unit 15, and it is possible to inhibit the operation of the recording unit 15 from being obstructed. Further, the foreign material removed from the front surface Ma of the medium M by the blowing unit 40 is further suppressed from moving toward the recording unit 15, and it is possible to further inhibit the operation of the recording unit 15 from being obstructed.

(5) The blowing unit 40 includes the nozzle 43 capable of blowing the gas in the direction from the recording unit 15 toward the tension roller 31. When the tangent line at the intersection point Ps at which an extension line of the nozzle 43 intersects with the tension roller 31 is the reference line TL, of the reference line TL, the blowing angle θ that is an angle formed by a line segment extending further downstream of the intersection point Ps in the transport direction Y1 is from zero degrees to 90 degrees.

When the foreign material attached to the front surface Ma of the medium M that is in close contact with the tension roller 31 is blown off by the gas flow blown from the blowing unit 40, the foreign material floats in the vicinity of the recording device 11. Depending on the direction of the gas flow or the blowing angle, the floating foreign material may become reattached to the medium M and there is a possibility that the image quality may deteriorate. In contrast, according to the present embodiment, it is possible to suppress the foreign material from reattaching to the medium M.

(6) The blowing unit 40 is movable relative to the tension roller 31. Thus, when the medium M is set with respect to the tension roller 31, the blowing unit 40 can be moved away from the tension roller 31, for example. In this way, space is secured for setting the medium M, and the setting of the medium M becomes easier.

(7) The blowing unit 40 includes the duct 42 through which the gas flow can pass, and the plurality of fans 41 accommodated inside the duct 42 and aligned in the duct width direction DW that intersects with the airflow direction FD in which the gas flow flows. The duct 42 includes the inclined region 54 in which the height of a duct inner space in the height direction H intersecting the airflow direction FD and the duct width direction DW becomes continuously smaller toward the nozzle 43 in the airflow direction FD.

Thus, when the plurality of fans 41 are aligned in the duct width direction DW intersecting the airflow direction FD, the air pressure can be increased compared to a case in which the single fan 41 is provided. However, fluctuations in a velocity distribution of the airflow in the duct width direction DW may occur due to the intervals between the plurality of fans 41 and the like. According to the configuration described above, the duct 42 includes the inclined region 54 positioned between the fans 41 and the nozzle 43, and the duct inner height of the inclined region 54 becomes continuously smaller toward the nozzle 43 in the airflow direction FD. As a result, the velocity distribution of the airflow in the duct width direction DW becomes uniform. In this way, the uniform airflow can be blown across the entire width of the medium M, and the foreign material removal performance is thus improved.

(8) The cover 30 is provided that is capable of covering the medium M upstream of the recording unit 15 and downstream of the tension roller 31 in the transport direction Y1 of the medium M. Thus, the cover 30 can suppress the floating foreign material blown off by the blowing unit 40 from reattaching to the medium M upstream of the recording unit 15 and downstream of the tension roller 31.

(9) The cover 30 can be displaced with respect to the transporting unit 16. Thus, the ease of setting the medium M in the transporting unit 16 can be improved.

(10) The blowing unit 40 is provided on the cover 30 and is movable, along with the cover 30, with respect to the tension roller 31. Thus, since the cover 30 also serves as the movement mechanism of the tension roller 31, there is no need to provide a dedicated movement mechanism that allows the tension roller 31 to move.

Second Embodiment

Next, a second embodiment will be described with reference to FIG. 8. An object onto which the blowing unit blows the airflow differs from the first embodiment. In the first embodiment, the blowing unit 40 blows the airflow onto the tension roller 31, but the blowing unit 40 according to the second embodiment blows the air, which is the example of the gas, onto a portion of the medium M supported by the transporting belt 21, which is an example of a movable support unit that can move along with the medium M while supporting the medium M. In other words, the blowing unit 40 blows the airflow onto a portion of the support face 21*a* of the transporting belt 21 on which the medium M is supported.

Figure 8:
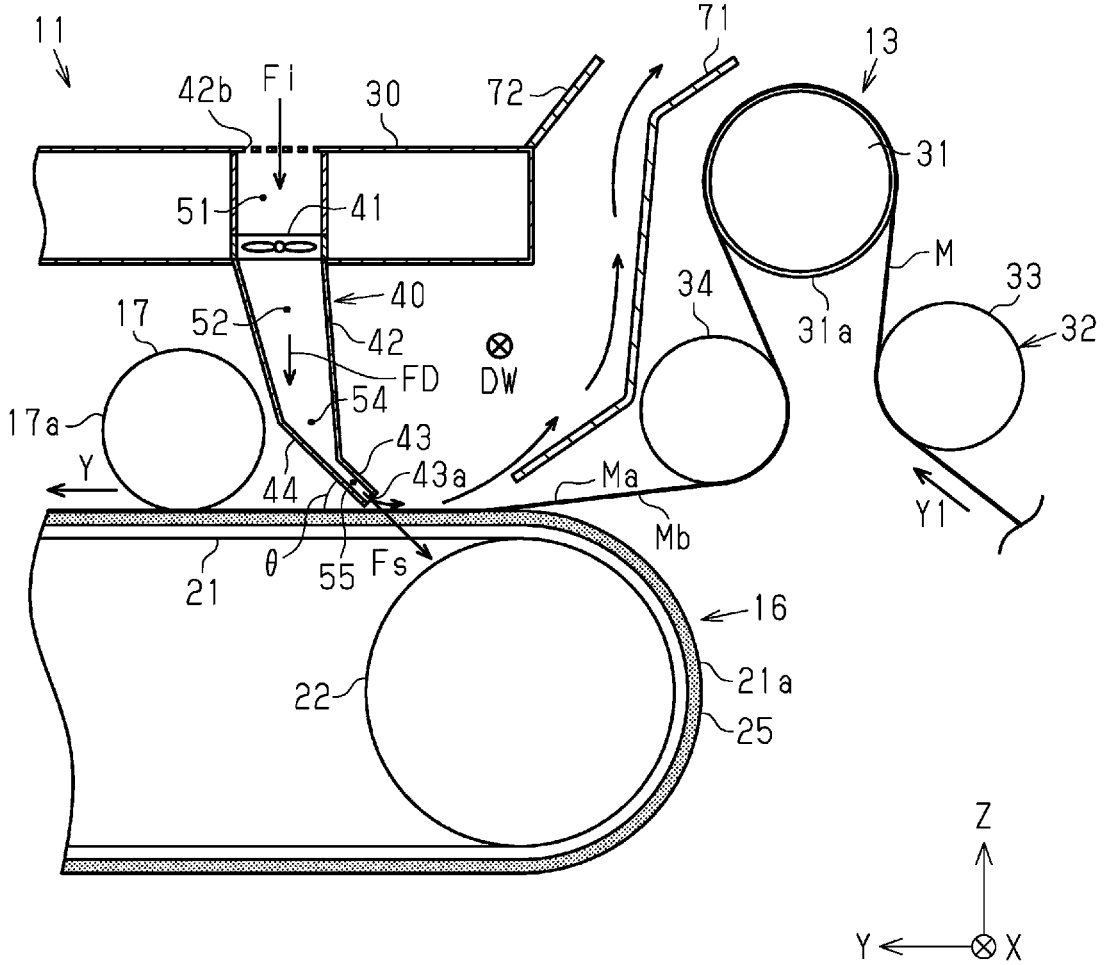
FIG. 8 is a schematic side cross-sectional view illustrating the blowing unit according to a second embodiment, and a periphery thereof.

As illustrated in FIG. 8, the recording device 11 includes the recording unit 15 capable of performing the recording on the medium M, the holding unit 12 capable of holding the roll body R1 on which the medium M is wound, and the transporting unit 16 that is the example of the transport unit that transports the medium M unwound from the roll body R1. Furthermore, the recording device 11 includes the blowing unit 40 that blows the air, as the example of the gas, onto the front surface Ma of the medium M.

The transporting unit 16 includes the support face 21*a* that supports the back surface Mb of the medium M unwound from the roll body R1, and includes the transporting belt 21 as the example of the movable support unit that transportably moves the medium M. Furthermore, the transporting unit 16 includes the adhesive layer 25 as an example of an contact force imparting portion that imparts an contact force causing the medium M to be in close contact with the support face 21*a* of the transporting belt 21.

The blowing unit 40 is disposed at a position facing the support face 21*a* of the transporting belt 21. The blowing unit 40 blows the air toward the support face 21*a* of the transporting belt 21. In other words, the blowing unit 40 blows the airflow from the nozzle 43 onto a portion of the support face 21*a* of the transporting belt 21 to which the medium M is adhered. The transporting belt 21 is in a state of being pulled between the driving roller 22 and the driven roller 23, and an upper side portion of the transporting belt 21 supporting the medium M is supported by a support member (not illustrated) for the purpose of preventing sagging. As a result, the transporting belt 21 moves in a state in which the transporting belt 21 does not become displaced downward, in particular. Further, the nozzle 43 of the blowing unit 40 is oriented toward a position above a portion of the support face 21*a* of the transporting belt 21 at which the back surface Mb of the medium M is adhered to the adhesive layer 25. For this reason, the portion of the medium M that is blown by the nozzle 43 of the blowing unit 40 is adhered, by the adhesive layer 25, to the support face 21*a* at a predetermined adhesion strength. In other words, the back surface Mb of the portion of the medium M onto which the airflow is blown from the nozzle 43 is in close contact with the support face 21*a* of the transporting belt 21 at the predetermined adhesion strength.

As illustrated in FIG. 8, the blowing unit 40 is attached to the cover 30. Thus, by opening and closing the cover 30, the blowing unit 40 is movable to a blowing position illustrated in FIG. 8 that blows the airflow onto the support face 21*a* of the transporting belt 21, and to a retracted position away from the transporting belt 21.

The basic configuration of the blowing unit 40 is similar to that of the first embodiment. The blowing unit 40 is provided with the fan 41 and the duct 42. A plurality of the fans 41 are disposed in the duct 42 in the duct width direction DW. The duct 42 includes the air intake chamber 51 and the exhaust chamber 52. The duct 42 includes the nozzle 43 that is oriented toward the support face 21*a* of the transporting belt 21. The duct 42 includes the air intake ports 42*b* that are communicated with the air intake chamber 51. Further, the duct 42 includes the inclined region 54, which is the example of the rectifying region in which the duct inner height decreases continuously toward the nozzle 43, and the nozzle region 55 that extends at the constant duct inner height that has become narrower in the inclined region 54. The duct 42 is provided with the inclined portion 44 forming the inclined region 54 and the nozzle 43 forming the nozzle region 55. The outlet port 43*a* is open at the tip of the nozzle 43.

The airflow supplied by the fans 41 in the duct 42 passes through the inclined region 54 and the flow velocity distribution is thus made uniform. Furthermore, the airflow is further made uniform in the nozzle region 55 that extends at the constant height and width. As a result, the airflow of the uniform flow velocity and flow rate in the duct width direction DW from the nozzle 43 is blown onto the front surface Ma of the medium M on the support face 21*a*.

An opening width NW of the outlet port 43*a* of the nozzle 43 (see FIG. 5) is equal to or greater than the width of the medium M. In the present example, a dimension of the opening width NW of the outlet port 43*a* is equal to or greater than a maximum width of the medium M that can be handled by the recording device 11. Thus, the uniform airflow blown from the nozzle 43 is blown across the entire width of the medium M. The portion of the medium M onto which the airflow is blown is adhered to the support face 21*a* by a predetermined contact force, so the medium M does not flap about. Thus, foreign material, such as fluff, attached to the front surface Ma of the medium M can be effectively removed while maintaining the stable posture of the medium M.

Further, in the present embodiment also, the air intake direction Fi when the blowing unit 40 takes in the outside air from the intake ports 42*b*, and the blowing direction Fs, which is the direction in which the airflow is blown from the nozzle 43, intersect each other. In particular, in the present example, the air intake direction Fi is the direction taking in the outside air from the upper side toward the lower side of the recording device 11, and the blowing direction Fs includes a directional component in a direction opposite to the belt transport direction Y with respect to the support face 21*a* that is the target of the blowing. The blowing angle θ is expressed by the angle formed between the blowing direction Fs of the nozzle 43, and the support face 21*a*, that is, the front surface Ma of the medium M adhered to the support face 21*a*. The blowing angle θ is set to a value from 0 degrees to 90 degrees such that the blowing direction Fs has the directional component in the direction opposite to the belt transport direction Y. If the blowing angle θ is too small, it is necessary for the tip of the nozzle 43 to be closer to the front surface Ma of the medium M, and there is a concern that there may be contact between the nozzle 43 and the medium M due to an assembly error or a position shift of the blowing unit 40. For this reason, the blowing angle θ is preferably equal to or greater than 30 degrees. Further, if the blowing angle θ is too large, a proportion of the amount of airflow flowing downstream in the belt transport direction Y with respect to the amount of airflow flowing upstream in the belt transport direction Y after the airflow collides with the front surface Ma of the medium M becomes relatively large, and there is a concern that the airflow that blows away the foreign material, such as fluff, may flow in the direction of the recording unit 15. Thus, the blowing angle θ is preferably less than 70 degrees. Therefore, the blowing angle θ is preferably from 30 degrees to less than 70 degrees.

In particular, in the present example, based on experiment results and simulation results of the airflow, the blowing angle θ is set to a value from 45 degrees to less than 55 degrees, taking into account the two points of the foreign material removal performance when the strong airflow (high pressure air) is caused to be blown onto the front surface Ma, and the foreign material reattachment prevention performance when the airflow containing the foreign material is prevented from flowing in the direction of the recording unit 15. When the blowing angle θ is less than 45 degrees, the deterioration is observed in the foreign material removal performance, and when the blowing angle θ is equal to or greater than 55 degrees, the ratio of the airflow flowing in the direction of the recording unit 15 increases and the deterioration is observed in the foreign material reattachment prevention performance.

As illustrated in FIG. 8, at a position between the blowing unit 40 and the wrinkle suppressing device 13, a guide member 71 is provided that guides, upward, the airflow that has flowed up stream in the belt transport direction Y, after the airflow blown from the blowing unit 40 has collided with the support face 21*a*. The guide member 71 has a plate shape obtained by bending a plate member. The guide member 71 has a width dimension greater than the width of the medium M in the width direction X, and extends vertically so as to cover portions of the medium M on the downstream side in the belt transport direction Y with respect to the wrinkle suppressing device 13. From the airflow blown from the nozzle 43, the guide member 71 guides the airflow to above the recording device 11, while protecting the portions of the medium M passing through each of the rollers 31, 33, and 34 of the wrinkle suppressing device 13.

Further, as illustrated in FIG. 8, a second guide member 72 is attached to the tip end of the cover 30, and when the cover 30 is in the closed position illustrated in FIG. 8, the second guide member 72 guides the airflow that has been guided upward by the first guide member 71 upstream in the belt transport direction Y. This second guide member 72 prevents the airflow guided upward by the first guide member 71 from flowing around the outer periphery of the air intake ports 42*b* of the blowing unit 40. As a result, the air containing foreign material is prevented from being taken in from the air intake ports 42*b*. Thus, it is possible to prevent the outside air containing the foreign material from being taken in from the air intake ports 42*b* and the airflow containing the foreign material from being blown from the blowing unit 40, and thus prevent the foreign material from reattaching to the front surface Ma of the medium M.

As described above, according to the second embodiment, the following effects are obtained.

(11) The transporting unit 16 that transports the medium M unwound from the roll body R1 includes the support face 21*a* that supports the back surface Mb of the medium M unwound from the roll body R1, and also includes the transporting belt 21 that transportably moves the medium M. Furthermore, the transporting unit 16 includes the adhesive layer 25 as an example of an contact force imparting portion that imparts an contact force causing the medium M to be in close contact with the support face 21*a* of the transporting belt 21. The blowing unit 40 blows the airflow toward the support face 21*a* of the transporting belt 21. In this way, the blowing unit 40 blows the airflow onto the front surface Ma of the medium M.

The blowing unit 40 blows the airflow onto the front surface Ma of the portion of the medium M at which the medium M is in close contact with the support face 21*a* of the transporting belt 21. Since the medium M is in close contact with the transporting belt 21, the medium M does not flap even when the airflow is blown. Further, the fact that the direction in which the airflow is blown from the nozzle 43 is the direction in which the medium M is pressed against the support face 21*a* contributes to the suppression of the flapping. Furthermore, it is possible to avoid a situation in which an end portion of the medium M is turned up due to the momentum of the airflow blown from the nozzle 43, or a situation in which the airflow enters between the medium M and the support face 21*a*, a portion of the medium M lifts up from the support face 21*a*, and the lifted portion flaps. In this way, it is possible to remove foreign material, such as fluff, attached to the front surface Ma of the medium M while inhibiting the posture of the medium M from becoming unstable. Thus, an image can be recorded on the medium M by a stable recording operation. Here, the stable recording operation refers to suppressing a deterioration in image quality by causing the posture of the medium M to be stable, and improving the image quality by the removal of foreign material from the front surface Ma, which is the recording surface of the medium M.

Note that the above-described embodiments may be modified as in the following modified examples. Furthermore, the above-described embodiments and the modified examples described below can be further modified as appropriate, or appropriate combinations of the following modified examples can be used as further modified examples. Each of the modified examples described below can be applied regardless of the embodiment, unless otherwise indicated.

In each of the embodiments, it is sufficient that the blowing direction Fs of the blowing unit 40 be a direction that includes a directional component in the direction opposite to the belt transport direction Y. There is no problem as long as there is a blocking portion that blocks the infiltration of the airflow into the recording unit 15 at a position at which the airflow flows from the blowing unit 40.

The blowing unit 40 may blow gas other than the air onto the front surface Ma of the medium M. For example, nitrogen gas or a noble gas that is inert at room temperature may be used. For example, a reactive gas that reacts with the front surface Ma of the medium M to improve the front surface Ma of medium M may be used. When a gas other than the air is used, a tank or the like filled with the gas other than the air is preferably coupled to the air intake port 42*b* via a tube.

In each of the embodiments, the feeding motor 27 and the winding motor 28 may be controlled by the control unit 100. In this case, the feeding motor 27 is driven in synchronization with the transport motor 26, which is the drive source of the transporting belt 21, and is rotationally controlled by the control unit 100 so that excessive tension is not applied to the medium M and also so that slack does not occur. Further, by controlling the winding motor 28, the control unit 100 controls the peeling operation by winding the roll body R2 held by the peeling device 14.

When the recording device 11 is the serial printer, the transport operation and the recording operation are alternately performed. Thus, the transport motor 26 is intermittently driven. In accordance with the intermittent driving of the transport motor 26, the feeding motor 27 is intermittently driven at a timing with a predetermined delay. Tension is applied to the portion of the medium M wound around the tension roller 31 and the portion of the medium M downstream of the transport direction Y1.

In the first embodiment, any appropriate position on the outer circumferential surface of the tension roller 31 may be selected as the blowing position Ps. It is sufficient that the airflow be blown onto the front surface Ma of the portion of the medium M wound around the outer circumferential surface of the tension roller 31.

The number of the fans 41 may be one. Further, the number of the fans 41 may be a plurality other than five, may be a plurality of six or more, or may be a plurality of less than five.

The configuration is not limited to the configuration in which the cover 30 also functions as the retraction mechanism of the blowing unit 40 as well as covering, from above, the portion of the transporting unit 16 other than that covered by the housing 11*a*. A dedicated retraction mechanism may be provided that retracts the blowing unit 40 from the blowing position at which the gas is to be blown to a retracted position away from the tension roller 31. The retraction mechanism may slide the blowing unit 40 in the width direction X along a rail (not illustrated) away from the tension roller 31, or may slide the blowing unit 40 in the belt transport direction Y away from the tension roller 31. Even in this case, the operation to set the medium M becomes easier.

The rectifying region in the duct 42 may be a region in which the duct inner height decreases in a stepwise manner toward the nozzle 43. In other words, the rectifying region in the duct 42 may be the region in which the duct inner height decreases in the stepwise manner toward the nozzle 43.

The gas blown by the blowing unit 40 need not necessarily be air. In this case, a nitrogen gas, a noble gas, or the like having low reactivity is preferable. For example, a cylinder filled with gas is coupled to an air intake chamber of the blowing unit 40, and the gas supplied from the cylinder is blown from the nozzle by a fan.

When the blowing unit 40 is positioned in the blowing position, the air intake port 42*b* may be provided on a side opposite to the outlet port 43*a* with respect to the fan 41 in the belt transport direction Y. Even in such a case, foreign material, such as fluff, blown away as a result of the air blowing can be prevented from being taken back into the duct 42 from the intake port 42*b*.

When the transport unit is the transporting belt type, the method for adhering the medium M to the support face 21*a* is not limited to glue belt that is the transporting belt 21 including the adhesive layer 25. As a method for causing the medium M to be in close contact with the support face 21*a* of the transporting belt 21, the transporting unit 16 may include a suction unit using an electrostatic attraction method that causes the medium M to be attracted using an electrostatic force, or a suction unit using a negative pressure suction method that sucks the medium M using negative pressure. In particular, in the second embodiment, when the transporting unit 16, which is the example of the transport unit, is configured to include the electrostatic attraction type suction unit that causes the medium M to be attracted using the electrostatic force, the electrostatic attraction method suction unit configures an example of the contact force imparting unit. In addition, when the transporting unit 16 is configured to include the negative pressure type suction unit that sucks the medium M using the negative pressure, the negative pressure method suction unit configures an example of the contact force imparting unit. The portion of the medium M blown by the blowing unit 40 is attracted onto the support face 21*a* of the transporting belt 21, which is an example of the movable support member, as a result of the suction force generated by the suction unit using the electrostatic attraction method or the negative pressure suction method. Of these, the medium M is in close contact with the supported portion. The blowing unit 40 blows the air as an example of the gas onto the support face 21*a* of the transporting belt 21. The blowing unit 40 blows the airflow onto the portion of the support face 21*a* of the transporting belt 21 on which the medium M is supported. Thus, even when the blowing unit 40 blows the airflow, the medium M does not flap.

In the second embodiment, when the recording device 11 does not include the pressing unit 17, the air may be blown from the blowing unit 40 onto the portion of the support face 21*a* of the transporting belt 21 on which the medium M is supported, provided the position is located upstream of the recording unit 15 in the belt transport direction Y. In this case, the blowing direction Fs is preferably a direction having a component oriented upstream in the belt transport direction Y.

In each of the embodiments, the blowing direction Fs of the blowing unit 40 may be a direction also including a component oriented downstream in the transport direction Y1. For example, a blocking member may be provided that prevents the airflow from flowing toward the recording unit 15 after the airflow has collided with the front surface Ma of the medium M.

The transport unit may use a roll-to-roll method. In other words, the transporting belt is not provided, and the medium M is transported between the first roll body R1 for feeding the medium M and the second roll body R2 for taking up the medium M, which are provided on both sides with a support interposed therebetween, by winding the medium M onto the second roll body R2 while sliding the medium M fed out from the first roll body R1 along a support face of the support. The recording unit 15 records the portion of the medium M on the support face of the support table. In this case, as in the first embodiment, the wrinkle suppressing device 13 may be provided, and the medium M may be wound around the tension roller 31.

The transport unit may be a recording device in which, in place of the transporting belt 21, a support member such as a platen is disposed at a position facing the recording unit, and the medium M is transported using a transport roller pair.

The recording device 11 is not limited to a printing machine that performs recording on fabric, and may be a recording device that prints on roll paper. The recording device 11 may print on the roll paper using a dot impact method. According to this configuration, paper powder or dust in the air can also be blown away.

The recording device 11 is not limited to the line printer in which the recording unit 15 reciprocates in the scanning direction X or the line printer in which the recording unit 15 extends in the width direction, and the recording device 11 may be a lateral printer in which the recording unit 15 can move in two directions, namely, the main scanning direction and a sub scanning direction.

The recording device 11 is not limited to an ink-jet method, and may use a wire impact method or a heat-transfer method. Further, the recording device 11 may be an electrophotographic method for fixing an image or the like to the medium M by various photosensitive techniques, after applying a solid toner.

The recording device 11 may be a complex device equipped with a reading unit.

The medium M of the roll body R1 is not limited to the fabric, and may be roll paper, a flexible plastic film, a nonwoven fabric, a knitted material, or the like, or may be a rolled laminate film or metal foil.

The recording device is not limited to a printer for recording. For example, a liquid body in which particles of a functional material are dispersed or mixed into a liquid may be ejected, and pixels of various types of display, such as electrical wiring patterns or liquid crystals, EL (electroluminescence), or surface emission, may be produced on a substrate, which is an example of a medium.

The recording device 11 is not limited to the ink jet-type, and may be a wire impact-type liquid ejection device or a heat transfer-type liquid ejection device. The recording method is not particularly limited as long as the liquid ejection device includes a gap adjustment mechanism that adjusts the gap between the recording head and the support portion.

Technical concepts derived from the above-described embodiments and modified examples are described below in conjunction with the effects thereof.

A recording device includes a recording unit configured to perform recording on a medium, a holding unit configured to hold a roll body around which the medium is wound, a transport unit configured to transport the medium unwound from the roll body, a tension bar configured to come into contact with a back surface of the medium and apply tension to the medium, between the holding portion and the recording unit, and a blowing unit configured to blow a gas onto a front surface of the medium. The blowing unit blows the gas toward the tension bar.

According to this configuration, the tension is applied to the medium as a result of the tension bar coming into contact with the back surface of the medium, between the holding portion and the recording unit. Thus, the medium is in close contact with the tension bar. Then, the blowing unit blows the gas toward the tension bar. The gas is blown onto a portion at which the medium is in the close contact with the tension bar. Thus, even when the gas is blown, the medium does not flap. In this way, it is possible to remove foreign material, such as dust, attached to the front surface of the medium, while inhibiting a posture of the medium from becoming unstable. Thus, a stable recording operation can be achieved. The stable recording operation referred to here refers to the fact that, as a result of the posture of the medium being stable, it is possible to suppress a deterioration in image quality caused by variations in a gap between the recording unit and the medium being transported by the transport unit, and to the fact that, at the same time, the image quality is improved due to the removal of the foreign material from the front surface that is a recording surface of the medium.

In the above-described recording device, a friction member may be provided on a portion, of the tension bar, in contact with the back surface of the medium.

According to this configuration, the medium can be wound, by a roller pair, around the tension bar on which the friction member is provided on the portion that is in contact with the back surface of the medium. In this way, it is possible to inhibit the medium from becoming displaced in a width direction intersecting a transport direction, and the posture of the medium can be further stabilized.

The above-described recording device may include a roller pair configured to wind the medium around the tension bar, and the medium may be wound, by the roller pair, around at least a half circumference of the tension bar.

According to this configuration, the medium can be wound, by the roller pair, around at least the half circumference of the tension bar. In this way, compared to a case in which a winding angle is less than the half circumference, it is possible to increase the tension of the portion of the medium wound around the tension bar. By suppressing lateral displacement in the width direction of the medium in this way, the occurrence of wrinkles in the medium can be suppressed, and the posture of the medium can be further stabilized.

In the above-described recording device, the blowing unit may blow the gas toward the tension bar and a direction of a flow of the gas may be a direction opposite to the transport direction in which the medium is transported toward the recording unit.

When the direction of the flow of the gas is the same as the transport direction in which the medium is transported toward the recording unit, foreign material removed from the front surface of the medium by the blowing unit moves toward the recording unit, and the foreign material attaches to at least a part of the recording unit. According to the above-described configuration, it is possible to suppress the foreign material removed from the front surface of the medium by the blowing unit from moving toward the recording unit, and it is thus possible to inhibit an operation of the recording unit from being obstructed.

In the above-described recording device, the blowing unit may include a nozzle configured to blow the gas in a direction from the recording unit toward the tension bar, and, when a tangent line of an intersection point at which an extension line of the nozzle intersects the tension bar is a reference line, an angle between the extension line and a portion of the reference line downstream of the intersection point in a transport direction of the medium at the intersection point, is 0 degrees or more and 90 degrees or more.

When the foreign material attached to the front surface of the medium that is in close contact with the tension roller is blown off by the gas flow from the blowing unit, the foreign material floats in the vicinity of the recording device. Depending on the direction of the gas flow or a blowing angle, the floating foreign material may become reattached to the medium and there is a possibility that the image quality may deteriorate. According to the above-described configuration, it is possible to suppress the foreign material from reattaching to the medium. Further, the foreign material removed from the front surface of the medium by the blowing unit is further suppressed from moving toward the recording unit, and it is possible to further inhibit the operation of the recording unit from being obstructed.

In the above-described recording device, the blowing unit may be configured to move with respect to the tension bar.

According to this configuration, when the medium is set on the tension bar, the blowing unit can be moved away from the tension bar, for example. In this way, space is secured for setting the medium, and the setting of the medium become easier.

In the above-described recording device, the blowing unit may include a duct through which a gas flow passes, and a plurality of fans accommodated inside the duct and aligned in a duct width direction intersecting an airflow direction in which the gas flows. The duct may include a nozzle configured to blow the gas flow, and a rectifying region, which is positioned between the plurality of fans and the nozzle in the airflow direction, and in which a duct inner height intersecting the airflow direction and the duct width direction decreases in one of a continuous and a stepwise manner toward the nozzle in the airflow direction.

According to this configuration, when the plurality of fans are arranged in the duct width direction intersecting the airflow direction, an air pressure can be increased compared to a case in which a single fan is provided. However, fluctuations in a velocity distribution of the airflow in the duct width direction may occur due to intervals between the plurality of fans, and the like. According to the above-described configuration, the duct includes the rectifying region positioned between the fans and the nozzle, and the duct inner height thereof decreases in the continuous or the stepwise manner toward the nozzle in the airflow direction. In this way, the velocity distribution of the airflow in the duct width direction becomes uniform. As a result, the uniform airflow can be blown across the entire width of the medium, and a foreign material removal performance is thus improved.

The above-described recording device may include a cover configured to cover the medium upstream of the recording portion and downstream of the tension bar in a transport direction of the medium.

According to this configuration, the cover can suppress foreign material, which is floating as a result of being blown off by the blowing unit, from reattaching to the medium upstream of the recording unit and downstream of the tension bar.

In the above-described recording device, the cover may be configured to be displaced with respect to the transport unit. According to this configuration, ease of setting the medium in the transport unit can be improved.

In the above-described recording device, the blowing unit may be provided on the cover and may be configured to move, with the cover, with respect to the tension bar.

According to this configuration, since the cover also serves as a movement mechanism of the tension bar, there is no need to provide a dedicated movement mechanism that allows the tension bar to move.

A recording device includes a recording unit configured to perform recording on a medium, a holding unit configured to hold a roll body around which the medium is wound, a transport unit configured to transport the medium unwound from the roll body, and a blowing unit configured to blow a gas onto a front surface of the medium. The transport unit includes a moving support unit including a support surface supporting a back surface of the medium unwound from the roll body, the moving support unit being configured to move while transporting the medium, and an contact force imparting unit configured to impart an contact force causing the medium to be in close contact with the support surface of the moving support unit. The blowing unit blows the gas toward the support surface of the moving support unit.

According to this configuration, the medium is transported as a result of the moving support unit moving in a state in which the back surface of the medium is supported by the support surface. At this time, the medium is adhered to the support surface of the moving support unit by the contact force imparted by the contact force imparting unit. Then, the blowing unit blows the gas toward the support surface of the moving support unit. The gas is blown onto the front surface of the portion of the medium that is in close contact with the support surface of the moving support unit. Thus, even when the gas flow is blown, the medium does not flap. In this way, it is possible to remove foreign material, such as dust, attached to the front surface of the medium, while inhibiting a posture of the medium from becoming unstable. Thus, a stable recording operation can be achieved. Here, the stable recording operation refers to the fact that the deterioration in image quality is suppressed by causing the posture of the medium to be stable, and that the image quality is improved by the removal of the foreign material.

What is claimed is:

1. A recording device comprising:

a recording unit configured to perform recording on a medium;

a holding unit configured to hold a roll body around which the medium is wound;

a transport unit configured to transport the medium unwound from the roll body;

a tension bar configured to come into contact with a back surface of the medium and apply tension to the medium, between the holding portion and the recording unit;

a cover configured to cover the medium upstream of the recording unit and downstream of the tension bar in a transport direction of the medium; and a blowing unit configured to blow a gas onto a front surface of the medium, wherein the blowing unit blows the gas toward the tension bar, and the blowing unit is attached to the cover and is configured to be movable, with the cover, relative to the tension bar.

2. The recording device according to claim 1, wherein a friction member is provided at a portion, of the tension bar, in contact with the back surface of the medium.

3. The recording device according to claim 1, comprising:

a roller pair configured to wind the medium around the tension bar, wherein the roller pair is configured to wind the medium around at least a half circumference of the tension bar.

4. The recording device according to claim 1, wherein the blowing unit blows the gas toward the tension bar such that a direction of a flow of the gas is a direction opposite to a transport direction in which the medium is transported toward the recording unit.

5. The recording device according to claim 1, wherein the blowing unit includes a nozzle configured to blow the gas in a direction from the recording unit toward the tension bar, and when a tangent line at an intersection point at which an extension line of the nozzle intersects the tension bar is a reference line, an angle between the extension line and a portion of the reference line downstream of the intersection point in a transport direction of the medium at the intersection point, is 0 degrees or more and 90 degrees or less.

6. The recording device according to claim 1, wherein the blowing unit is configured to move with respect to the tension bar.

7. The recording device according to claim 1, wherein the blowing unit includes a duct through which the gas is configured to pass, and a plurality of fans accommodated inside the duct and aligned in a duct width direction intersecting an airflow direction in which the gas flows, and the duct includes a nozzle configured to blow the gas, and a rectifying region, which is positioned between the plurality of fans and the nozzle in the airflow direction, and in which a duct inner height intersecting the airflow direction and the duct width direction decreases in a continuous or a stepwise manner toward the nozzle in the airflow direction.

8. The recording device according to claim 1, wherein the cover is configured to be displaced with respect to the transport unit.

9. The recording device according to claim 1, wherein the recording device is provided at the cover and is configured to move, with the cover, with respect to the tension bar.

10. A recording device comprising:

a recording unit configured to perform recording on a medium;

a holding unit configured to hold a roll body around which the medium is wound;

a transport unit configured to transport the medium unwound from the roll body;

a cover configured to cover the medium upstream of the recording unit in a transport direction of the medium; and a blowing unit configured to blow a gas onto a front surface of the medium, wherein the transport unit includes a moving support unit including a support surface supporting a back surface of the medium unwound from the roll body, the moving support unit being configured to move while transporting the medium, and a contact force imparting unit configured to impart a contact force causing the medium to be in contact with the support surface of the moving support unit, the blowing unit blows the gas toward the support surface of the moving support unit, and the blowing unit is attached to the cover and is configured to be moveable, with the cover, relative to the support surface.

11. The recording device according to claim 1, comprising:

a pressing unit provided upstream of the recording unit and downstream of the tension bar in a transport direction in which the medium is transported toward the recording unit; and a first cover configured to cover the recording unit when the cover is a second cover configured to cover the pressing unit; wherein the transport unit includes a moving support unit including a support surface supporting a back surface of the medium unwound from the roll body, the moving support unit being configured to move while transporting the medium, and the pressing unit presses the medium against the support surface.

12. The recording device according to claim 11, wherein the second cover is configured to be displaced relative to the first cover.

* * * * *